US010979844B2

(12) United States Patent
Noh et al.

(10) Patent No.: US 10,979,844 B2
(45) Date of Patent: Apr. 13, 2021

(54) DISTRIBUTED AUDIO VIRTUALIZATION SYSTEMS

(71) Applicant: DTS, Inc., Calabasas, CA (US)

(72) Inventors: Daekyoung Noh, Huntington Beach, CA (US); Jean-Marc Jot, Aptos, CA (US); Twafik Mohamed, Bangor (GB)

(73) Assignee: DTS, Inc., Calabasas, CA (US)

( * ) Notice: Subject to any disclaimer, the term of this patent is extended or adjusted under 35 U.S.C. 154(b) by 0 days.

(21) Appl. No.: 15/844,096

(22) Filed: Dec. 15, 2017

(65) Prior Publication Data

US 2018/0262858 A1 Sep. 13, 2018

Related U.S. Application Data

(60) Provisional application No. 62/468,677, filed on Mar. 8, 2017.

(51) Int. Cl.
*H04S 7/00* (2006.01)

(52) U.S. Cl.
CPC ..... *H04S 7/304* (2013.01); *H04S 2420/01* (2013.01)

(58) Field of Classification Search
CPC ... H04S 7/304; H04S 2420/01; H04S 2400/00
USPC ..... 381/310
See application file for complete search history.

(56) References Cited

U.S. PATENT DOCUMENTS 4,817,149 A 3/1989 Myers
5,742,689 A 4/1998 Tucker et al.
5,943,427 A 8/1999 Massie et al.
6,078,669 A 6/2000 Maher
(Continued)

FOREIGN PATENT DOCUMENTS

CN 104604257 A 5/2015
CN 105376691 A 3/2016
(Continued)

OTHER PUBLICATIONS

"U.S. Appl. No. 15/587,903, Final Office Action dated Aug. 9, 2018", 26 pgs.
(Continued)

*Primary Examiner* — Vivian C Chin
*Assistant Examiner* — Douglas J Suthers
(74) *Attorney, Agent, or Firm* — Schwegman Lundberg & Woessner, P.A.

(57) ABSTRACT

An audio signal processing system can be configured to provide virtualized audio information in a three-dimensional soundfield using at least a pair of loudspeakers or headphones. The system can include an audio input configured to receive audio program information that includes at least N discrete audio signals, a first virtualization processor circuit configured to generate intermediate virtualized audio information by filtering M of the N audio signals, and a second virtualization processor circuit configured to generate further virtualized audio information by differently filtering K of the N audio signals, wherein K, M, and N are integers. The system can include an audio signal combination circuit to combine the intermediate virtualized audio information with at least one of the N audio signals, other than the M audio signals, to render fewer than N audio signals for transmission to a second virtualization processor circuit.

20 Claims, 6 Drawing Sheets

(56) References Cited

U.S. PATENT DOCUMENTS

| | | | | |
|---|---|---|---|---|
| 6,175,631 | B1 | 1/2001 | Davis et al. | |
| 6,421,446 | B1 | 7/2002 | Cashion et al. | |
| 6,498,857 | B1 | 12/2002 | Sibbald | |
| 6,766,028 | B1 | 7/2004 | Dickens | |
| 6,956,954 | B1 | 10/2005 | Takemura et al. | |
| 6,961,439 | B2 | 11/2005 | Ballas | |
| 7,092,541 | B1 | 8/2006 | Eberbach | |
| 7,158,642 | B2 | 1/2007 | Tsuhako | |
| 7,177,431 | B2 | 2/2007 | Davis et al. | |
| 7,415,123 | B2 | 8/2008 | Ballas | |
| 7,480,389 | B2 | 1/2009 | Ricks et al. | |
| 7,606,377 | B2 | 10/2009 | Melanson | |
| 7,702,116 | B2 | 4/2010 | Stone et al. | |
| 7,876,914 | B2 | 1/2011 | Grosvenor et al. | |
| 8,000,485 | B2 | 8/2011 | Walsh et al. | |
| 8,023,660 | B2 | 9/2011 | Faller | |
| 8,027,477 | B2 | 9/2011 | Wang | |
| 8,126,172 | B2 | 2/2012 | Horbach et al. | |
| 8,150,061 | B2 | 4/2012 | Ozawa | |
| 8,254,583 | B2 | 8/2012 | Kim | |
| 8,270,616 | B2 | 9/2012 | Slamka et al. | |
| 8,325,933 | B2 | 12/2012 | Melchior et al. | |
| 8,374,365 | B2 | 2/2013 | Goodwin et al. | |
| 8,442,244 | B1 | 5/2013 | Long, Jr. | |
| 8,532,305 | B2 | 9/2013 | Vickers | |
| 8,638,946 | B1 | 1/2014 | Mahabub | |
| 8,712,061 | B2 | 4/2014 | Jot et al. | |
| 8,885,834 | B2 | 11/2014 | Kuhr et al. | |
| 8,976,972 | B2 | 3/2015 | Emerit et al. | |
| 9,009,057 | B2 | 4/2015 | Breebaart et al. | |
| 9,100,767 | B2 | 8/2015 | Van Baelen et al. | |
| 9,167,369 | B2 | 10/2015 | Takumai et al. | |
| 9,264,838 | B2 | 2/2016 | Stein et al. | |
| 2001/0040968 | A1 | 11/2001 | Mukojima | |
| 2007/0061026 | A1 | 3/2007 | Wang | |
| 2007/0160216 | A1 | 7/2007 | Nicol et al. | |
| 2008/0004729 | A1 | 1/2008 | Hiipakka | |
| 2008/0273708 | A1 | 11/2008 | Sandgren et al. | |
| 2009/0046864 | A1 | 2/2009 | Mahabub et al. | |
| 2010/0303246 | A1* | 12/2010 | Walsh | H04S 3/002 381/18 |
| 2011/0081024 | A1 | 4/2011 | Soulodre | |
| 2011/0222693 | A1 | 9/2011 | Lee et al. | |
| 2011/0243338 | A1 | 10/2011 | Brown | |
| 2012/0008789 | A1 | 1/2012 | Kim et al. | |
| 2013/0156213 | A1 | 6/2013 | Pan et al. | |
| 2013/0202117 | A1 | 8/2013 | Brungart et al. | |
| 2013/0308800 | A1 | 11/2013 | Bacon | |
| 2014/0023197 | A1 | 1/2014 | Xiang et al. | |
| 2014/0072121 | A1 | 3/2014 | Harma et al. | |
| 2014/0100856 | A1 | 4/2014 | Beack et al. | |
| 2014/0185811 | A1 | 7/2014 | Stein et al. | |
| 2014/0270185 | A1 | 9/2014 | Walsh | |
| 2014/0334626 | A1 | 11/2014 | Lee et al. | |
| 2015/0131824 | A1 | 5/2015 | Nguyen et al. | |
| 2015/0146873 | A1 | 5/2015 | Chabanne et al. | |
| 2015/0223002 | A1 | 8/2015 | Mehta et al. | |
| 2015/0304791 | A1 | 10/2015 | Crockett | |
| 2015/0350802 | A1* | 12/2015 | Jo | H04S 3/008 381/1 |
| 2015/0373454 | A1 | 12/2015 | Shidoji | |
| 2015/0382127 | A1 | 12/2015 | Sun et al. | |
| 2016/0044431 | A1 | 2/2016 | Kraemer et al. | |
| 2016/0044434 | A1* | 2/2016 | Chon | H04S 5/005 381/18 |
| 2016/0050508 | A1 | 2/2016 | Redmann | |
| 2016/0111096 | A1 | 4/2016 | Oh et al. | |
| 2016/0133263 | A1 | 5/2016 | Borss et al. | |
| 2016/0134989 | A1 | 5/2016 | Herre et al. | |
| 2016/0142853 | A1 | 5/2016 | Herre et al. | |
| 2017/0011751 | A1 | 1/2017 | Fueg et al. | |
| 2017/0094438 | A1 | 3/2017 | Chon et al. | |
| 2017/0188169 | A1 | 6/2017 | Chon et al. | |
| 2017/0325043 | A1 | 11/2017 | Jot et al. | |

FOREIGN PATENT DOCUMENTS

| | | | |
|---|---|---|---|
| CN | 104604257 | B | 5/2016 |
| CN | 102272840 | B | 2/2017 |
| EP | 2866227 | A1 | 4/2015 |
| EP | 3125240 | A1 | 2/2017 |
| WO | WO-2013149867 | A1 | 10/2013 |
| WO | WO-2014036121 | A1 | 3/2014 |
| WO | 2016130834 | | 8/2016 |
| WO | WO-2017097324 | A1 | 6/2017 |
| WO | WO-2017192972 | A1 | 11/2017 |
| WO | WO-2018164750 | A1 | 9/2018 |

OTHER PUBLICATIONS

"U.S. Appl. No. 15/587,903, Examiner Interview Summary filed Nov. 8, 2018", 1 pg.

"U.S. Appl. No. 15/587,903, Response filed Oct. 9, 2018 to Final Office Action dated Aug. 9, 2018", 17 pgs.

"International Application Serial No. PCT/US2017/031269, International Preliminary Report on Patentability dated Nov. 15, 2018", 15 pgs.

"International Application Serial No. PCT US2017 067026, International Search Report dated Mar. 8, 2018", 2 pgs.

"International Application Serial No. PCT US2017 067026, Written Opinion dated Mar. 8, 2018", 9 pgs.

"U.S. Appl. No. 15/587,903, Non Final Office Action dated May 31, 2019", 25 pgs.

"International Application Serial No. PCT/US2017/031269, International Search Report dated Sep. 1, 2017", 4 pgs.

"International Application Serial No. PCT/US2017/031269, Invitation to Pay Add'l Fees and Partial Search Report dated Jun. 22, 2017", 2 pgs.

"International Application Serial No. PCT/US2017/031269, Written Opinion dated Sep. 1, 2017", 13 pgs.

Breebaart, Jeroen, et al., "Phantom Materialization: a Novel Method to Enhance Stereo Audio Reproduction on Headphones", IEEE Trans. Audi o, Speech and Language Proc. 16(8), (Nov. 2008), 1503-1511.

Jo, H, et al., "Apply spectral cues to generate elevated sound sources displayed via ear-level loudspeakers", Proc. Internoise, (Sep. 2011), 1-6.

Jo, Hyun, et al., "Confirming the Perception of Virtual Source Elevation Effects Created using 5.1 Channel Surround Sound Playback", Proc. ACM SIGGRAPH Sponsored 9th Int. Conf. on VRCAI, (Dec. 2010), 103-110.

Kim, Sungyoung, et al., "Virtual Ceiling Speaker: Elevating auditory imagery in a 5-channel reproduction", Convention Paper 7886. Proc. Audio Eng. Soc., presented at the 127th Convention, (Oct. 2009), 1-12.

Lee, K, et al., "Immersive Virtual Sound Beyond 5.1 Channel Audio", Convention Paper 8117. Proc. Audio Eng. Soc., presented at the128th Convention, (May 2010), 1-9.

Lee, Young Woo, et al., "Virtual Height Speaker Rendering for Samsung 10.2-channel Vertical Surround System", Convention Paper 8523.Proc. AES, presented at the 131st Convention, (Oct. 2011), 1-10.

Lopez, Jose, et al., "Experiments on the Perception of Elevated Sources in Wave-Field Synthesis using HRTF Cues", Convention Paper 8070. Proc. AES, 128th Convention, (May 2010), 1-14.

"U.S. Appl. No. 15/587,903, Response filed Apr. 16, 2018 to Non Final Office Action dated Dec. 14, 2017", 15 pgs.

"U.S. Appl. No. 15/587,903, Advisory Action dated Nov. 30, 2018", 4 pgs.

"U.S. Appl. No. 15/587,903, Response filed Jan. 9, 2019 to Final Office Action dated Aug. 9, 2018", 22 pgs.

"U.S. Appl. No. 15/587,903, Non Final Office Action dated Dec. 14, 2017", 26 pgs.

"U.S. Appl. No. 15/587,903, Final Office Action dated Dec. 31, 2019", 30 pgs.

"U.S. Appl. No. 15/587,903, Response filed Sep. 5, 2019 to Non-Final Office Action dated May 31, 2019", 29 pgs.

(56) References Cited

OTHER PUBLICATIONS

"International Application Serial No. PCT/US2017/067026, International Preliminary Report on Patentability dated Sep. 19, 2019", 11 pgs.
"Chinese Application Serial No. 201780090501.5, Office Action dated Jan. 5, 2021", with English translation, 33 pgs.
"European Application Serial No. 17900117.7, Extended European Search Report dated Nov. 6, 2020", 15 pgs.

* cited by examiner

DISTRIBUTED AUDIO VIRTUALIZATION SYSTEMS

CLAIM OF PRIORITY

This patent application claims the benefit of priority to U.S. Provisional Patent Application No. 62/468,677, filed on Mar. 8, 2017, which is incorporated by reference herein in its entirety.

BACKGROUND

Audio plays a significant role in providing a content-rich multimedia experience in consumer electronics. The scalability and mobility of consumer electronic devices along with the growth of wireless connectivity provides users with instant access to content. Various audio reproduction systems can be used for playback over headphones or loudspeakers. In some examples, audio program content can include more than a stereo pair of audio signals, such as including surround sound or other multiple-channel configurations.

A conventional audio reproduction system can receive digital or analog audio source signal information from various audio or audio/video sources, such as a CD player, a TV tuner, a handheld media player, or the like. The audio reproduction system can include a home theater receiver or an automotive audio system dedicated to the selection, processing, and routing of broadcast audio and/or video signals. Audio output signals can be processed and output for playback over a speaker system. Such output signals can be two-channel signals sent to headphones or a pair of frontal loudspeakers, or multi-channel signals for surround sound playback. For surround sound playback, the audio reproduction system may include a multichannel decoder.

The audio reproduction system can further include processing equipment such as analog-to-digital converters for connecting analog audio sources, or digital audio input interfaces. The audio reproduction system may include a digital signal processor for processing audio signals, as well as digital-to-analog converters and signal amplifiers for converting the processed output signals to electrical signals sent to the transducers. The loudspeakers can be arranged in a variety of configurations as determined by various applications. Loudspeakers, for example, can be stand-alone units or can be incorporated in a device, such as in the case of consumer electronics such as a television set, laptop computer, hand held stereo, or the like. Due to technical and physical constraints, audio playback can be compromised or limited in such devices. Such limitations can be particularly evident in electronic devices having physical constraints where speakers are narrowly spaced apart, such as in laptops and other compact mobile devices. To address such audio constraints, various audio processing methods are used for reproducing two-channel or multi-channel audio signals over a pair of headphones or a pair of loudspeakers. Such methods include compelling spatial enhancement effects to improve the listener's experience.

Various techniques have been proposed for implementing audio signal processing based on Head-Related Transfer Functions (HRTF), such as for three-dimensional audio reproduction using headphones or loudspeakers. In some examples, the techniques are used for reproducing virtual loudspeakers localized in a horizontal plane with respect to a listener, or located at an elevated position with respect to the listener. To reduce horizontal localization artifacts for listener positions away from a "sweet spot" in a loudspeaker-based system, various filters can be applied to restrict the effect to lower frequencies.

OVERVIEW

Audio signal processing can be distributed across multiple processor circuits or software modules, such as in scalable systems or due to system constraints. For example, a TV audio system solution can include combined digital audio decoder and virtualizer post-processing modules so that an overall computational budget does not exceed the capacity of a single Integrated Circuit (IC) or System-On-Chip (SOC). To accommodate such a limitation, the decoder and virtualizer blocks can be implemented in separate cascaded hardware or software modules.

In an example, an internal I/O data bus, such as in TV audio system architecture, can be limited to 6 or 8 channels (e.g., corresponding to 5.1 or 7.1 surround sound systems). However, it can be desired or required to transmit a greater number of decoder output audio signals to a virtualizer input to provide a compelling immersive audio experience. The present inventors have thus recognized that a problem to be solved includes distributing audio signal processing across multiple processor circuits and/or devices to enable multi-dimensional audio reproduction of multiple-channel audio signals over loudspeakers or, in some examples, headphones. In an example, the problem can include using legacy hardware architecture with channel count limitations to distribute or process multi-dimensional audio information.

A solution to the above-described problem includes various methods for multi-dimensional audio reproduction using loudspeakers or headphones, such as can be used for playback of immersive audio content over sound bar loudspeakers, home theater systems, TVs, laptop computers, mobile or wearable devices, or other systems or devices. The methods and systems described herein can enable distribution of virtualization post-processing across two or more processor circuits or modules while reducing an intermediate transmitted audio channel count.

In an example, a solution can include or use a method for providing virtualized audio information that includes receiving audio program information comprising at least N discrete audio signals, and generating, using a first virtualization processor circuit, intermediate virtualized audio information using at least a portion of the received audio program information. The generation of the intermediate virtualized audio information can include applying a first virtualization filter to M of the N audio signals to provide a first virtualization filter output, and providing the intermediate virtualized audio information using the first virtualization filter output, wherein the intermediate virtualized audio information comprises J discrete audio signals. The example can further include transmitting the intermediate virtualized audio information to a second virtualization processor circuit, wherein the second virtualization processor circuit is configured to generate further virtualized audio information by applying a different second virtualization filter to one or more of the J audio signals, and N, M, and J are integers. The example can further include rendering K output signals based on the J audio signals. In an example, M is less than N, and K is less than J. In an example, the first virtualization filter is different than the second virtualization filter. For example, the first virtualization filter can correspond to a virtualization in a first plane (e.g., a vertical plane) and the second virtualization filter can correspond to a virtualization in a different second plane (e.g., a horizontal plane). In an example, the solution includes or uses decorrelation processing. For example, the generation of the intermediate virtualized audio information can include decorrelating or performing decorrelation processing on at least one of the M audio signals before applying the first virtualization filter.

This overview is intended to provide a summary of the subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
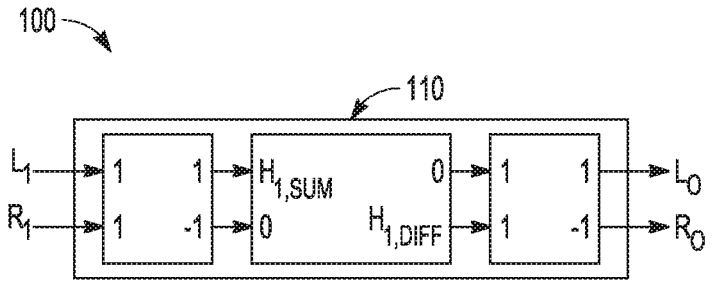
FIG. 1 illustrates generally an example of audio signal virtualization processing.

In the following description that includes examples of virtual environment rendering and audio signal processing, such as for reproduction via headphones or other loudspeakers, reference is made to the accompanying drawings, which form a part of the detailed description. The drawings show, by way of illustration, specific embodiments in which the inventions disclosed herein can be practiced. These embodiments are also referred to herein as "examples." Such examples can include elements in addition to those shown or described. However, the present inventors also contemplate examples in which only those elements shown or described are provided. The present inventors contemplate examples using any combination or permutation of those elements shown or described (or one or more aspects thereof), either with respect to a particular example (or one or more aspects thereof), or with respect to other examples (or one or more aspects thereof) shown or described herein.

As used herein, the phrase "audio signal" is a signal that is representative of a physical sound. Audio processing systems and methods described herein can include hardware circuitry and/or software configured to use or process audio signals using various filters. In some examples, the systems and methods can use signals from, or signals corresponding to, multiple audio channels. In an example, an audio signal can include a digital signal that includes information corresponding to multiple audio channels.

Various audio processing systems and methods can be used to reproduce two-channel or multi-channel audio signals over various loudspeaker configurations. For example, audio signals can be reproduced over headphones, over a pair of bookshelf loudspeakers, or over a surround sound or immersive audio system, such as using loudspeakers positioned at various locations with respect to a listener. Some examples can include or use compelling spatial enhancement effects to enhance a listening experience, such as where a number or orientation of physical loudspeakers is limited.

In U.S. Pat. No. 8,000,485, to Walsh et al., entitled "Virtual Audio Processing for Loudspeaker or Headphone Playback", which is hereby incorporated by reference in its entirety, audio signals can be processed with a virtualizer processor circuit to create virtualized signals and a modified stereo image. Additionally or alternatively to the techniques in the '485 patent, the present inventors have recognized that virtualization processing can be used to deliver an accurate sound field representation that includes various spatially-oriented components using a minimum number of loudspeakers.

In an example, relative virtualization filters, such as can be derived from head-related transfer functions, can be applied to render virtual audio information that is perceived by a listener as including sound information at various specified altitudes, or elevations, above or below a listener to further enhance a listener's experience. In an example, such virtual audio information is reproduced using a loudspeaker provided in a horizontal plane and the virtual audio information is perceived to originate from a loudspeaker or other source that is elevated relative to the horizontal plane, such as even when no physical or real loudspeaker exists in the perceived origination location. In an example, the virtual audio information provides an impression of sound elevation, or an auditory illusion, that extends from, and optionally includes, audio information in the horizontal plane. Similarly, virtualization filters can be applied to render virtual audio information perceived by a listener as including sound information at various locations within or among the horizontal plane, such as at locations that do not correspond to a physical location of a loudspeaker in the sound field.

FIG. 1 illustrates generally an example 100 of audio signal virtualization processing. In the example 100, an input signal pair designated $L_1$ and $R_1$ are provided to a two-channel virtualizer module 110. The two-channel virtualizer module 110 can include a first processor circuit configured to processes the input signal pair and provide an output signal pair designated $L_O$ and $R_O$. In an example, the output signal pair is configured for playback using a stereo loudspeaker pair or headphones.

In an example, the virtualizer module 110 can be realized using a transaural shuffler topology such as when the input and output signal pairs represent information for loudspeakers that are symmetrically located relative to an anatomical median plane of a listener. In this example, sum and difference virtualization filters can be designated as shown in Equations (1) and (2), and can be applied by the first processor circuit in the two-channel virtualizer module 110.

$$H_{1,SUM}=\{H_{1i}+H_{1c}\}\{H_{0i}+H_{0c}\}^{-1}; \quad (1)$$

$$H_{1,DIFF}=\{H_{1i}-H_{1c}\}\{H_{0i}-H_{0c}\}^{-1} \quad (2)$$

In the example of Equations (1) and (2), dependence on frequency is omitted for simplification, and the following notations are used:

$H_{0i}$: ipsilateral HRTF for left or right physical loudspeaker locations (e.g., configured for reproduction of the output signal pair $L_O$, $R_O$);

$H_{0c}$: contralateral HRTF for left or right physical loudspeaker locations (e.g., configured for reproduction of the output signal pair $L_O$, $R_O$);

$H_{1i}$: ipsilateral HRTF for the left or right virtual loudspeaker locations (e.g., configured for reproduction of the output signal pair $L_1$, $R_1$); and $H_{1c}$: contralateral HRTF for the left or right virtual loudspeaker locations ($L_1$, $R_1$). In the case of headphone reproduction, $H_{0c}$ is substantially zero and $H_{0i}$ corresponds to a headphone-to-ear transfer function.

Figure 2:
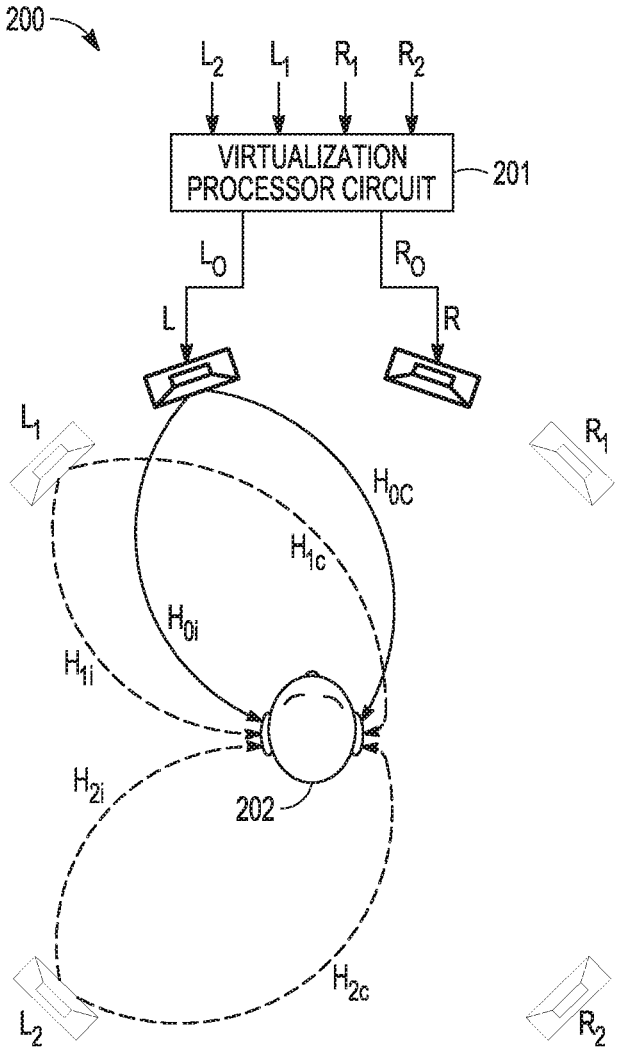
FIG. 2 illustrates generally an example of a four-channel three-dimensional audio reproduction system.

FIG. 2 illustrates generally an example 200 of a four-channel three-dimensional audio reproduction system. The example 200 can include or use virtualization processing to provide virtualized audio signal information for reproduction to a listener 202. In the example 200, a virtualization processor circuit 201 receives input signals $L_1$, $R_1$, $L_2$ and $R_2$ and applies virtualization processing to the input signals and renders or provides a fewer number of output signals than input signals. Binaural and transaural 3D audio virtualization algorithms can be used to process the various input signals, including sum and difference "shuffler"-based topologies that leverage properties such as left-right symmetry of channel layouts, minimum-phase models of head-related transfer functions (HRTFs) and spectral equalization methods, as well as digital IIR filter approximations. In an example, the virtualization processor circuit 201 receives the multiple input signals $L_1$, $R_1$, $L_2$ and $R_2$ from an audio decoder circuit, such as a surround sound decoder circuit, and renders substantially the same information using a pair of loudspeakers.

In FIG. 2, the three-dimensional audio reproduction system or processor circuit 201 provides output signals designated $L_O$ and $R_O$. Based on the virtualization processing, when the $L_O$ and $R_O$ signals are reproduced using a pair of loudspeakers (such as the loudspeakers corresponding to L and R in the example of FIG. 2), audio information is perceived by the listener 202 as including information from multiple sources distributed about the loudspeaker environment. For example, when the $L_O$ and $R_O$ signals are reproduced using the speakers designated in the figure as L and R, the listener 202 can perceive audio signal information as originating from the left or right front speakers $L_1$ and $R_1$, from the left or right rear speakers $L_2$ and $R_2$, or from an intermediate location or phantom source somewhere between the speakers.

Figure 3:
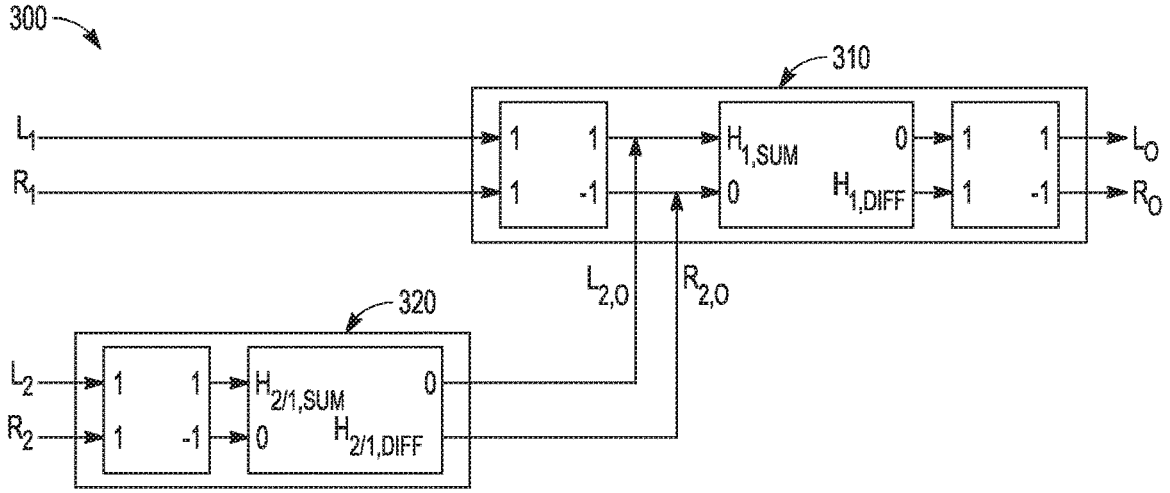
FIG. 3 illustrates generally an example of multiple-stage virtualization processing.

FIG. 3 illustrates generally an example 300 of multiple-stage virtualization processing. In an example, the three-dimensional audio reproduction system or processor circuit 201 from FIG. 2 can be implemented or applied using the virtualization processing in the example 300 of FIG. 3. The example of FIG. 3 includes a first two-channel virtualizer module 310 and a second two-channel virtualizer module 320. The first two-channel virtualizer module 310 is configured to receive a first input signal pair designated $L_1$ and $R_1$, and the second two-channel virtualizer module 320 is configured to receive a second input signal pair designated $L_2$ and $R_2$. In an example, $L_1$ and $R_1$ represent a front stereo pair and $L_2$ and $R_2$ represent a rear stereo pair (see, e.g., FIG. 2). In other examples, $L_1$, $R_1$, $L_2$ and $R_2$ can represent other audio information such as for side, rear, or elevated sound signals, such as configured or designed for reproduction using a particular loudspeaker arrangement. In an example, the first two-channel virtualizer module 310 is configured to apply or use sum and difference virtualization filters, such as shown in Equation (1).

The second two-channel virtualizer module 320 can include a second processor circuit configured to receive the second input signal pair $L_2$ and $R_2$ and generate intermediate virtualized audio information as output signals designated $L_{2,O}$ and $R_{2,O}$. In an example, the second two-channel virtualizer module 320 is configured to apply or use sum and difference virtualization filters, such as shown in Equation (2), to generate the intermediate virtualized output signals $L_{2,O}$ and $R_{2,O}$. In an example, the second two-channel virtualizer module 320 is thus configured to provide or generate a partially virtualized signal, or multiple signals that are partially virtualized. The signal or signals are considered to be partially virtualized because the second two-channel virtualizer module 320 can be configured to provide virtualization processing in a limited manner. For example, the second two-channel virtualizer module 320 can be configured for horizontal plane virtualization processing, while vertical plane virtualization processing can be performed elsewhere or using a different device. The partially virtualized signals can be combined with one or more other virtualized or non-virtualized signals before reproduction to a listener. In an example, the second two-channel virtualizer module 320 can apply or use the functions described in Equations 3 and 4 to provide the intermediate virtualized output signals.

$$H_{2/1,SUM}=\{H_{2i}+H_{2c}\}\{H_{1i}+H_{1c}\}^{-1}; \quad (3)$$

$$H_{2/1,DIFF}=\{H_{2i}-H_{2c}\}\{H_{1i}-H_{1c}\}^{-1} \quad (4)$$

In the example of Equations (3) and (4), dependence on frequency is omitted for simplification, and the following notations are used:

$H_{2i}$: ipsilateral HRTF for the left or right virtual loudspeaker locations ($L_2$, $R_2$);

$H_{2c}$: contralateral HRTF for the left or right virtual loudspeaker locations ($L_2$, $R_2$).

In the example of FIG. 3, the intermediate virtualized output signals $L_{2,O}$ and $R_{2,O}$ are combined with the first input signal pair designated $L_1$ and $R_1$ prior to virtualization of the first input signal pair designated $L_1$ and $R_1$. The combined signals are then further processed or virtualized using the first two-channel virtualizer module 310. The first and second two-channel virtualizer modules 310 and 320 can be configured to apply different virtualization processing such as to achieve different virtualization effects. For example, the first two-channel virtualizer module 310 can be configured to provide horizontal-plane virtualization processing, and the second two-channel virtualizer module 320 can be configured to provide vertical-plane virtualization processing. Other types of virtualization processing can similarly be used or applied using the different modules.

Figure 4:
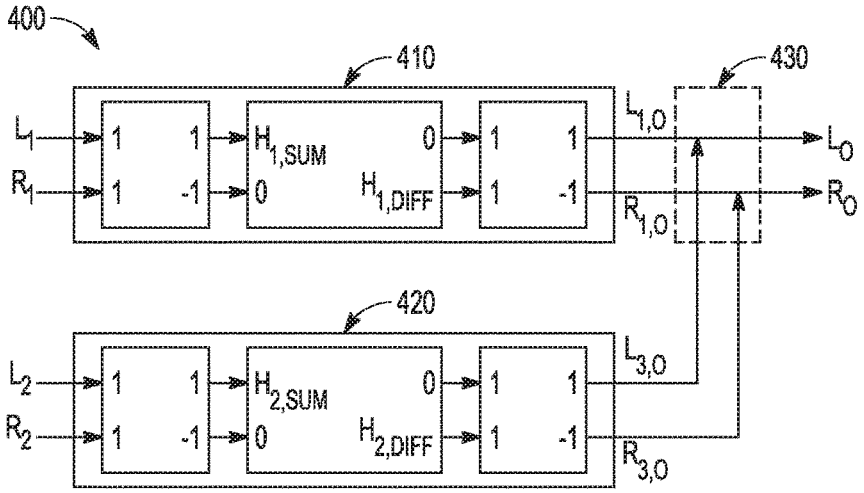
FIG. 4 illustrates generally an example that includes independent virtualization processing by first and second two-channel virtualizer modules.

The present inventors have recognized that a result of virtualization processing by modules 310 and 320 and combining the intermediate signals according to the example of FIG. 3 is substantially equivalent to virtualization processing by both modules independently. FIG. 4, for example, illustrates generally an example 400 that includes independent virtualization processing by first and second two-channel virtualizer modules 410 and 420. In the example of FIG. 4, the first two-channel virtualizer module 410 receives the input signal pair designated $L_1$ and $R_1$ and generates a partially virtualized output signal pair designated $L_{1,O}$ and $R_{1,O}$, and the second two-channel virtualizer module 420 receives the input signal pair designated $L_2$ and $R_2$ and generates a partially virtualized output signal pair designated $L_{3,O}$ and $R_{3,O}$. The example 400 of FIG. 4 further includes a summing module 430 that includes a circuit configured to sum the partially virtualized output signal pairs $L_{1,O}$ and $R_{1,O}$, and $L_{3,O}$ and $R_{3,O}$ to provide the virtualized output signals $L_O$ and $R_O$.

In the example of FIG. 4, the first two-channel virtualizer module 410 is configured to apply the sum and difference virtualization filters as shown in Equations (1) and (2), and as similarly described above in the example of the two-channel virtualizer module 110 from FIG. 1. The second two-channel virtualizer module 420 is configured to apply sum and different virtualization filters as shown in Equations (5) and (6).

$$H_{2,SUM}=\{H_{2i}+H_{2c}\}\{H_{0i}+H_{0c}\}^{-1}; \quad (5)$$

$$H_{2,DIFF}=\{H_{2i}-H_{2c}\}\{H_{0i}-H_{0c}\}^{-1} \quad (6)$$

By comparing Equations (1) and (2) with Equations (3) and (4), it can be observed that the four-channel pairwise virtualizer examples of FIGS. 3 and 4 are substantially the same.

Figure 5:
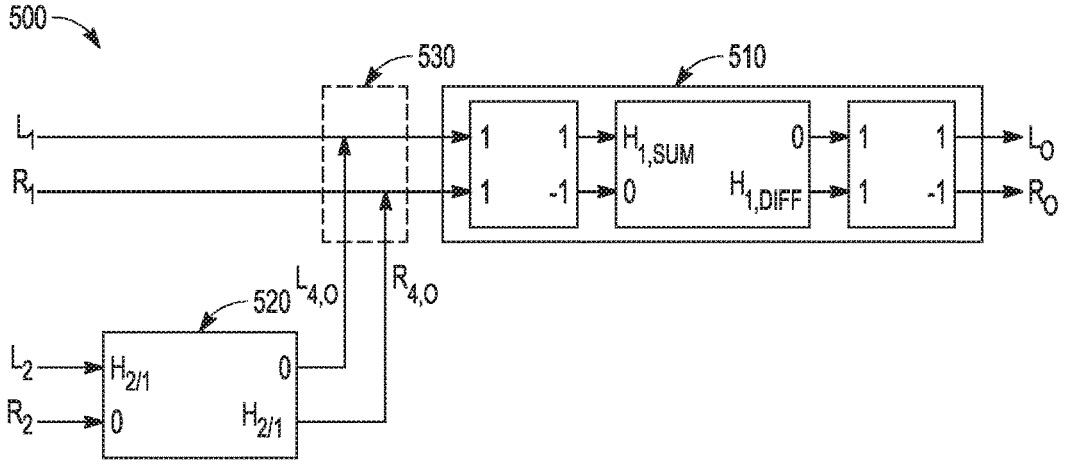
FIG. 5 illustrates generally an example that includes virtualization processing using first and second two-channel virtualizer modules.

FIG. 5 illustrates generally an example 500 that includes virtualization processing by first and second two-channel virtualizer modules 510 and 520. In the example of FIG. 5, the second two-channel virtualizer module 520 receives the input signal pair designated $L_2$ and $R_2$ and generates a partially virtualized output signal pair designated $L_{4,O}$ and $R_{4,O}$. The example 500 of FIG. 5 further includes a summing module 530 that includes a circuit configured to sum the partially virtualized output signal pair $L_{4,O}$ and $R_{4,O}$ with an input signal pair $L_1$ and $R_1$ and provide the summed signals to the first two-channel virtualizer module 510. The first two-channel virtualizer module 510 receives the summed signal pair and generates the virtualized output signals $L_O$ and $R_O$.

In the example of FIG. 5, the first two-channel virtualizer module 510 is configured to apply the sum and difference virtualization filters as shown in Equations (1) and (2), and as similarly described above in the example of the two-channel virtualizer module 110 from FIG. 1. The second two-channel virtualizer module 520 is configured to apply sum and different virtualization filters as shown in Equation (7).

$$H_{2/1}=H_{2i}/H_{1i}=H_{2c}/H_{1c} \quad (7)$$

The example of FIG. 5 thus illustrates generally a simplified version of the four-channel virtualizer of FIG. 3, wherein the second two-channel virtualizer module 520 applies the same filter to both input signals when the transfer functions $H_{2/1,SUM}$ and $H_{2/1,DIFF}$ are approximately equal, that is, when ipsilateral and contralateral HRTF ratios are approximately equal.

Any one or more of the virtualization processing examples described herein can include or use decorrelation processing. For example, any one of more of the virtualizer modules from FIGS. 1, 3, 4, and/or 5, can include or use a decorrelator circuit configured to decorrelate one or more of the audio input signals. In an example, a decorrelator circuit precedes at least one input of a virtualizer module such that the virtualizer module processes signal pairs that are decorrelated from each other. Further examples and discussion about decorrelation processing are provided below.

Figure 6:
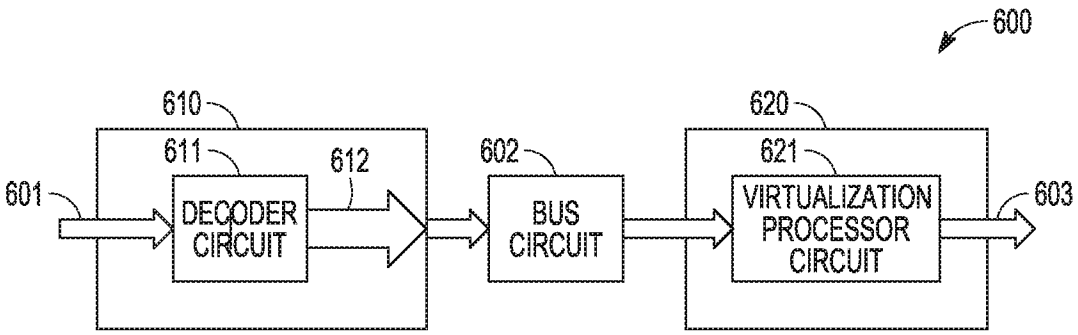
FIG. 6 illustrates generally an example of a block diagram that shows virtualization processing of multiple audio signals.

FIG. 6 illustrates generally an example 600 of a block diagram that shows virtualization processing of multiple audio signals. The example 600 includes a first audio signal processing device 610 coupled to a second audio signal processing device 620 using a data bus circuit 602.

The first audio signal processing device 610 can include a decoder circuit 611. In an example, the decoder circuit 611 receives a multiple-channel input signal 601 that includes digital or analog signal information. In an example, the multiple-channel input signal 601 includes a digital bit stream that includes information about multiple audio signals. In an example, the multiple-channel input signal 601 includes audio signals for a surround sound or an immersive audio program. In an example, an immersive audio program can include nine or more channels, such as in the DTS:X 11.1ch format. In an example, the immersive audio program includes eight channels, including left and right front channels ($L_1$ and $R_1$), a center channel (C), a low frequency channel (Lfe), left and right rear channels ($L_2$ and $R_2$), and left and right elevation channels ($L_3$ and $R_3$). Additional or fewer channels or signals can similarly be used.

The decoder circuit 611 can be configured to decode the multiple-channel input signal 601 and provide a decoder output 612. The decoder output 612 can include multiple discrete channels of information. For example, when the multiple-channel input signal 601 includes information about an 11.1 immersive audio program, then the decoder output 612 can include audio signals for twelve discrete audio channels. In an example, the bus circuit 602 includes at least twelve channels and transmits all of the audio signals from the first audio signal processing device 610 to the second audio signal processing device 620 using respective channels. The second audio signal processing device 620 can include a virtualization processor circuit 621 that is configured to receive one or more of the signals from the bus circuit 602. The virtualization processor circuit 621 can process the received signals, such as using one or more HRTFs or other filters, to generate an audio output signal 603 that includes virtualized audio signal information. In an example, the audio output signal 603 includes a stereo output pair of audio signals (e.g., $L_O$ and $R_O$) configured for reproduction using a pair of loudspeakers in a listening environment, or using headphones. In an example, the first or second audio signal processing device 610 or 620 can apply one or more filters or functions to accommodate artifacts related to the listening environment to further enhance a listener's experience or perception of virtualized components in the audio output signal 603.

In some audio signal processing devices, particularly at the consumer-grade level, the bus circuit 602 can be limited to a specified or predetermined number of discrete channels. For example, some devices can be configured to accommodate up to, but not greater than, six channels (e.g., corresponding to a 5.1 surround system). When audio program information includes greater than, e.g., six channels of information, then at least a portion of the audio program can be lost if the program information is transmitted using the bus circuit 602. In some examples, the lost information can be critical to the overall program or listener experience. The present inventors have recognized that this channel count problem can be solved using distributed virtualization processing.

Figure 7:
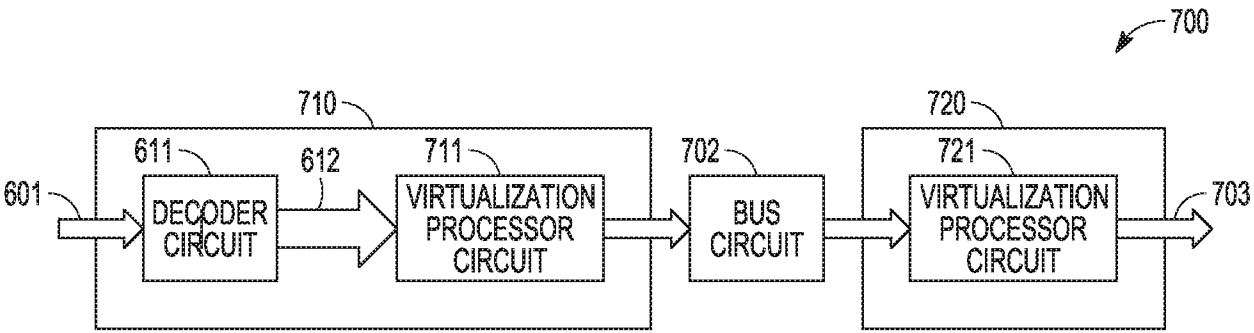
FIG. 7 illustrates generally an example that includes a distributed audio virtualization system.

FIG. 7 illustrates generally an example 700 that includes a distributed audio virtualization system. The example 700 can be used to provide multiple-channel immersive audio rendering such as using physical loudspeakers or headphones. The example 700 includes a first audio signal processing device 710 coupled to a second audio signal processing device 720 using a second data bus circuit 702. In an example, the second data bus circuit 702 includes the same bandwidth as is provided by the data bus circuit 602 in the example of FIG. 6. That is, the second data bus circuit 702 can include a bandwidth that is lower than may be required to carry all of the information about the multiple-channel input signal 601.

In the example of FIG. 7, the first audio signal processing device 710 can include the decoder circuit 611 and a first virtualization processor circuit 711. In an example, the decoder circuit 611 receives the multiple-channel input signal 601, such as can include digital or analog signal information. As similarly explained above in the example of FIG. 6, the multiple-channel input signal 601 includes a digital bit stream that includes information about multiple audio signals, and can, in an example, include audio signals for an immersive audio program.

The decoder circuit 611 can be configured to decode the multiple-channel input signal 601 and provide the decoder output 612. The decoder output 612 can include multiple discrete channels of information. For example, when the multiple-channel input signal 601 includes information about an immersive audio program (e.g., 11.1 format), then the decoder output 612 can include audio signals for, e.g., twelve discrete audio channels. In an example, the bus circuit 702 includes fewer than twelve channels and thus cannot transmit each of the audio signals from the first audio signal processing device 710 to the second audio signal processing device 720.

In an example, the decoder output 612 can be partially virtualized by the first audio signal processing device 710, such as using the first virtualization processor circuit 711. For example, the first virtualization processor circuit 711 can include or use the example 300 of FIG. 3, the example 400 of FIG. 4, or the example 500 of FIG. 5, to receive multiple input signals, apply first virtualization processing to at least a portion of the received input signals to render or provide intermediate virtualized audio information, and then combine the intermediate virtualized audio information with one or more others of the input signals.

Referring now to FIG. 7 and to FIG. 5 as a representative and non-limiting example, the multiple-channel input signal 601 (see FIG. 7) can include the input signal pairs designated $L_1$, $R_1$, $L_2$ and $R_2$ (see FIG. 5). The first virtualization processor circuit 711 can receive at least the input signal pair designated $L_2$ and $R_2$ and can perform first virtualization processing on the signal pair. In an example, the first virtualization processor circuit 711 applies first HRTF filters to one or more of the $L_2$ and $R_2$ signals to render or generate the partially virtualized output signal pair designated $L_{4,O}$ and $R_{4,O}$. The first virtualization processor circuit or a designated summing module can receive the partially virtualized output signal pair $L_{4,O}$ and $R_{4,O}$ and sum the partially virtualized output signal pair $L_{4,O}$ and $R_{4,O}$ with the other input signal pair $L_1$ and $R_1$. Following the summation of the signals, fewer than four audio signal channels are provided by the first audio signal processing device 710 to the second data bus circuit 702. Thus, in an example where the multiple-channel input signal 601 includes four audio signals, the second data bus circuit 702 can be used to transmit partially virtualized information from the first audio signal processing device 710 to another device, such as without a loss of information.

In the example of FIG. 7, the second data bus circuit 702 provides the partially virtualized information to the second audio signal processing device 720. The second audio signal processing device 720 can further process the received signals using a second virtualization processor circuit 721 and generate further virtualized output signals (e.g., output signals $L_O$ and $R_O$ in the example of FIG. 5).

The second virtualization processor circuit 721 can be configured to receive one or more of the signals from the second data bus circuit 702. The second virtualization processor circuit 721 can process the received signals, such as using one or more HRTFs or other filters, to generate an audio output signal 703 that includes virtualized audio signal information. In an example, the audio output signal 703 includes a stereo output pair of audio signals (e.g., $L_O$ and $R_O$ from the example of FIG. 5) configured for reproduction using a pair of loudspeakers in a listening environment, or using headphones. In an example, the first or second audio signal processing device 710 or 720 can apply one or more filters or functions to accommodate artifacts related to the listening environment to further enhance a listener's experience or perception of virtualized components in the audio output signal 703.

In other words, the example of FIG. 7 illustrates generally a first audio signal processing device 710 that includes a first virtualization processor circuit 711 that is configured to process or "virtualize" information from one or more channels in the multiple-channel input signal 601 to provide one or more corresponding intermediate virtualized signals. The intermediate virtualized signals can then be combined with one or more other channels in the multiple-channel input signal 601 to provide a partially virtualized audio program that includes fewer channels than were included in the multiple-channel input signal 601. That is, the first virtualization processor circuit 711 can receive an audio program that includes a first number of channels, then apply virtualization processing and render a fewer number of channels than were originally received with the audio program, such as without losing the information or fidelity provided by the other channels. The partially virtualized audio program can be transmitted using the second data bus circuit 702 without a loss of information, and the transmitted information can be further processed or further virtualized using another virtualization processor (e.g., using the second audio signal processing device 710 and/or the second virtualization processor circuit 721), such as before output to a sound reproduction system such as physical loudspeakers or headphones.

In an example, a method for providing virtualized audio information using the system of FIG. 7 includes receiving audio program information that includes at least N discrete audio signals, such as corresponding to the multiple-channel input signal 601. The method can include generating intermediate virtualized audio information such as using the first virtualization processor circuit 711 using at least a portion of the received audio program information. For example, generating the intermediate virtualized audio information can include applying a first virtualization filter (e.g., based on an HRTF) to M of the N audio signals to provide a first virtualization filter output and providing the intermediate virtualized audio information using the first virtualization filter output. In an example, the intermediate virtualized audio information comprises J discrete audio signals, and J is less than N. In an example, M is less than or equal to N. The method can further include transmitting the intermediate virtualized audio information using the second data bus circuit 702 to the second virtualization processor circuit 721, and the second data bus circuit 702 can have fewer than N channels. In an example, the second virtualization processor circuit 721 can be configured to generate further virtualized audio information by applying a different second virtualization filter to one or more of the J audio signals. For example, the first virtualization processor circuit 711 can be configured to apply horizontal-plane virtualization to at least the $L_2$ and $R_2$ signals to render or provide virtualized signals $L_{4,O}$ and $R_{4,O}$, such as can be combined with other input signals $L_1$ and $R_1$ and transmitted using the second data bus circuit 702. The second virtualization processor circuit 721 can be configured to apply other virtualization processing (e.g., vertical-plane virtualization) to the combined signals received from the second data bus circuit 702 to provide virtualized output signals for reproduction via loudspeakers or headphones.

Figure 8:
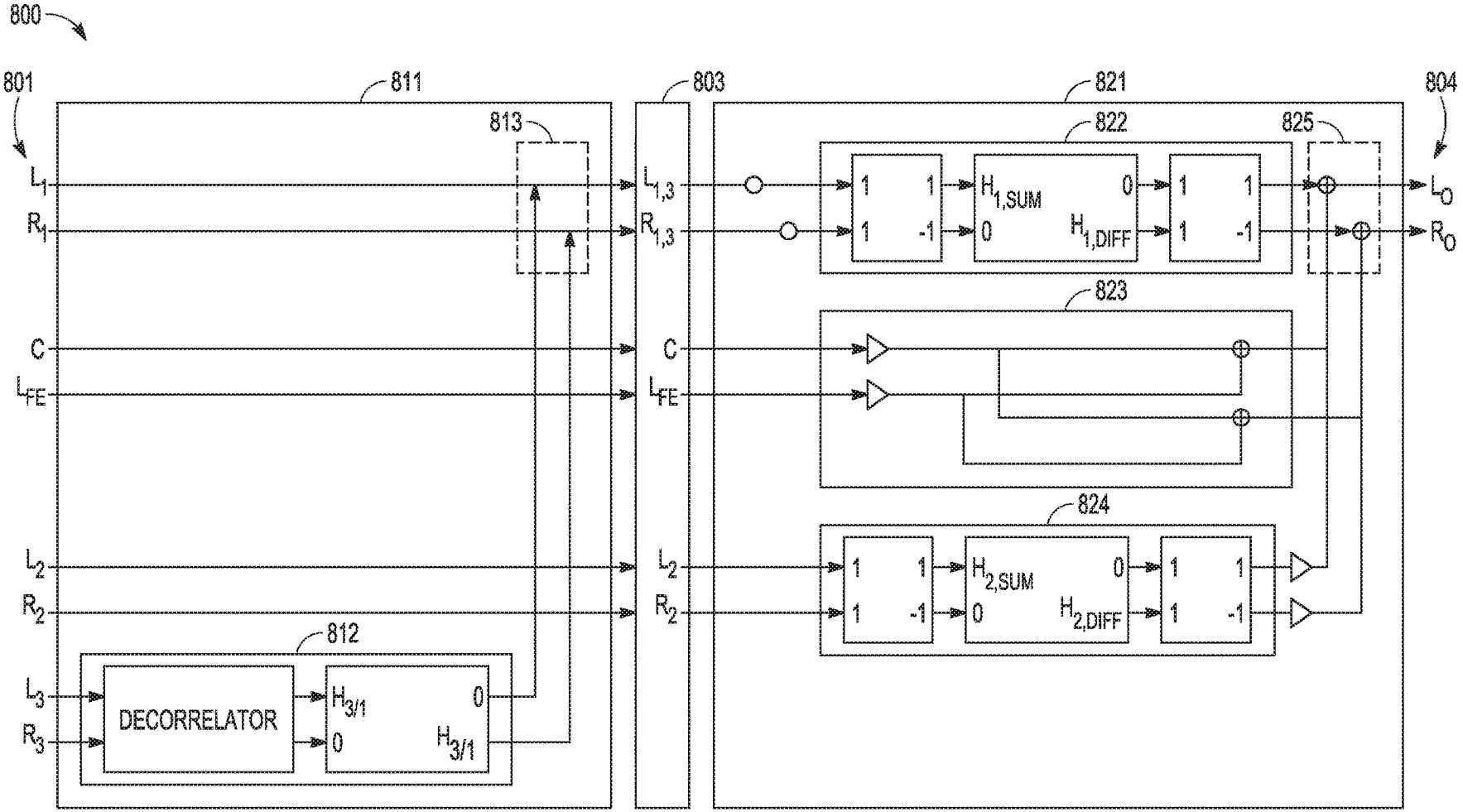
FIG. 8 illustrates generally an example of a first system configured to perform distributed virtualization processing on various audio signals.

FIG. 8 illustrates generally an example 800 of a first system configured to perform distributed virtualization processing on various audio signals. The example 800 includes a first audio processing module 811 coupled to a second audio processing module 821 using a third data bus circuit 803. The first audio processing module 811 is configured to receive various pairwise input signals 801, apply first virtualization processing and reduce a total audio signal or channel count by combining one or more signals or channels following the first virtualization processing. The first audio processing module 811 provides the reduced number of signals or channels to the second audio processing module 821 using the third data bus circuit 803. The second audio processing module 821 applies second virtualization processing and renders, in the example of FIG. 8, a pairwise output signal 804. In an example, the multiple pairwise input signals 801 include various channels that can receive immersive audio program information, including signal channels $L_1$ and $R_1$ (e.g., corresponding to a front stereo pair), $L_2$ and $R_2$ (e.g., corresponding to a rear stereo pair), $L_3$ and $R_3$ (e.g., corresponding to a height or elevated stereo pair), a center channel C, and a low frequency channel Lfe. The pairwise output signal 804 can include a stereo output pair of signals designated $L_O$ and $R_O$. Other channel types or designations can similarly be used.

In the example 800, the first audio processing module 811 includes first stage virtualization processing by a first processor circuit 812 that receives input signals $L_3$ and $R_3$, such as corresponding to height audio signals. The first processor circuit 812 includes a decorrelator circuit that is configured to apply decorrelation processing to at least one of the input signals $L_3$ and $R_3$, such as to enhance spatialization processing and reduce an occurrence of audio artifacts in the processed signals. Following the decorrelator circuit, the decorrelated input signals are processed or virtualized such as using a two-channel virtualizer module (see, e.g., the second two-channel virtualizer module 520 from the example of FIG. 5 and Equation (7)). Following the first processor circuit 812, output signals from the first processor circuit 812 can be combined with one or more others of the input signals 801. For example, as shown in FIG. 8, the output signals from the first processor circuit 812 can be combined or summed with the $L_1$ and $R_1$ signals, such as using a summing circuit 813, to render signals $L_{1,3}$ and $R_{1,3}$. One or more others of the input signals 801 can be processed using the first audio processing module 811, however, discussion of such other processing is omitted for brevity and simplicity of the present illustrative example. With the partially-virtualized $L_3$ and $R_3$ signals combined with the input signals $L_1$ and $R_1$ to provide signals $L_{1,3}$ and $R_{1,3}$, the first audio processing module 811 can thus provide six output signals (e.g., designated $L_{1,3}$, $R_{1,3}$, $L_2$, $R_2$, C, and Lfe in the example of FIG. 8) to the third data bus circuit 803.

The third data bus circuit 803 can transmit the six signals to the second audio processing module 821. In the example, the second audio processing module 821 includes multiple second-stage virtualization processing circuits, including a second processor circuit 822, third processor circuit 823, and fourth processor circuit 824. In the illustration, the second through fourth processor circuits 822-824 are shown as discrete processors however processing operations for one or more the circuits can be combined or performed using one or more physical processing circuits. The second processor circuit 822 is configured to receive the signals $L_{1,3}$, and $R_{1,3}$, the third processor circuit 823 is configured to receive the signals $L_2$, and $R_2$, and the fourth processor circuit 824 is configured to receive the signals C, and Lfe. The outputs of the second through fourth processor circuits 822-824 are provided to a second summing circuit 825 that is configured to sum output signals from the various processor circuits to render the pairwise output signal 804, designated $L_O$ and $R_O$.

In the example of FIG. 8, the second processor circuit 822 receives input signals $L_{1,3}$, and $R_{1,3}$, such as corresponding to a combination of the virtualized height audio signals from the first processor circuit 812 and the $L_1$ and $R_1$ signals as received by the first audio processing module 811. The second processor circuit 822 includes a decorrelator circuit that is configured to apply decorrelation processing to at least one of the input signals $L_{1,3}$ and $R_{1,3}$, such as to enhance spatialization processing and reduce an occurrence of audio artifacts in the processed signals. Following the decorrelator circuit, the decorrelated signals are processed or virtualized such as using a two-channel virtualizer module (see, e.g., the first two-channel virtualizer module 410 from the example of FIG. 4 and Equations (1 and 2)).

The fourth processor circuit 824 can optionally include a decorrelator circuit (not shown) that is configured to apply decorrelation processing to at least one of the input signals $L_2$ and $R_2$, such as to enhance spatialization processing and reduce an occurrence of audio artifacts in the processed signals. The input signals $L_2$ and $R_2$ are processed or virtualized such as using a two-channel virtualizer module (see, e.g., the second two-channel virtualizer module 420 from the example of FIG. 4 and Equations (5 and 6)). In the example of FIG. 8, the third processor circuit 823 is configured to receive and process the C and Lfe signals, such as optionally using an all-pass filter and/or decorrelation processing.

The example of FIG. 8 thus illustrates a pairwise multichannel virtualizer for two-channel output, such as over a frontal loudspeaker pair (see, e.g., FIG. 2) using pairwise virtualization processing, such as illustrated in FIGS. 1 and 3-5. In this example, the height channel pair ($L_3$, $R_3$) is processed using a first-stage virtualizer including a decorrelator. This virtualizer topology, including using a designated virtual height filter implemented by the first processor circuit 812, can be computationally advantageous because it enables sharing horizontal-plane virtualization processing with the front input signal pair. In addition, the illustrated topology allows an effectiveness or degree of the virtual height effect to be optimized or tuned, such as independently of the horizontal-plane or other virtualization processing.

Figure 9:
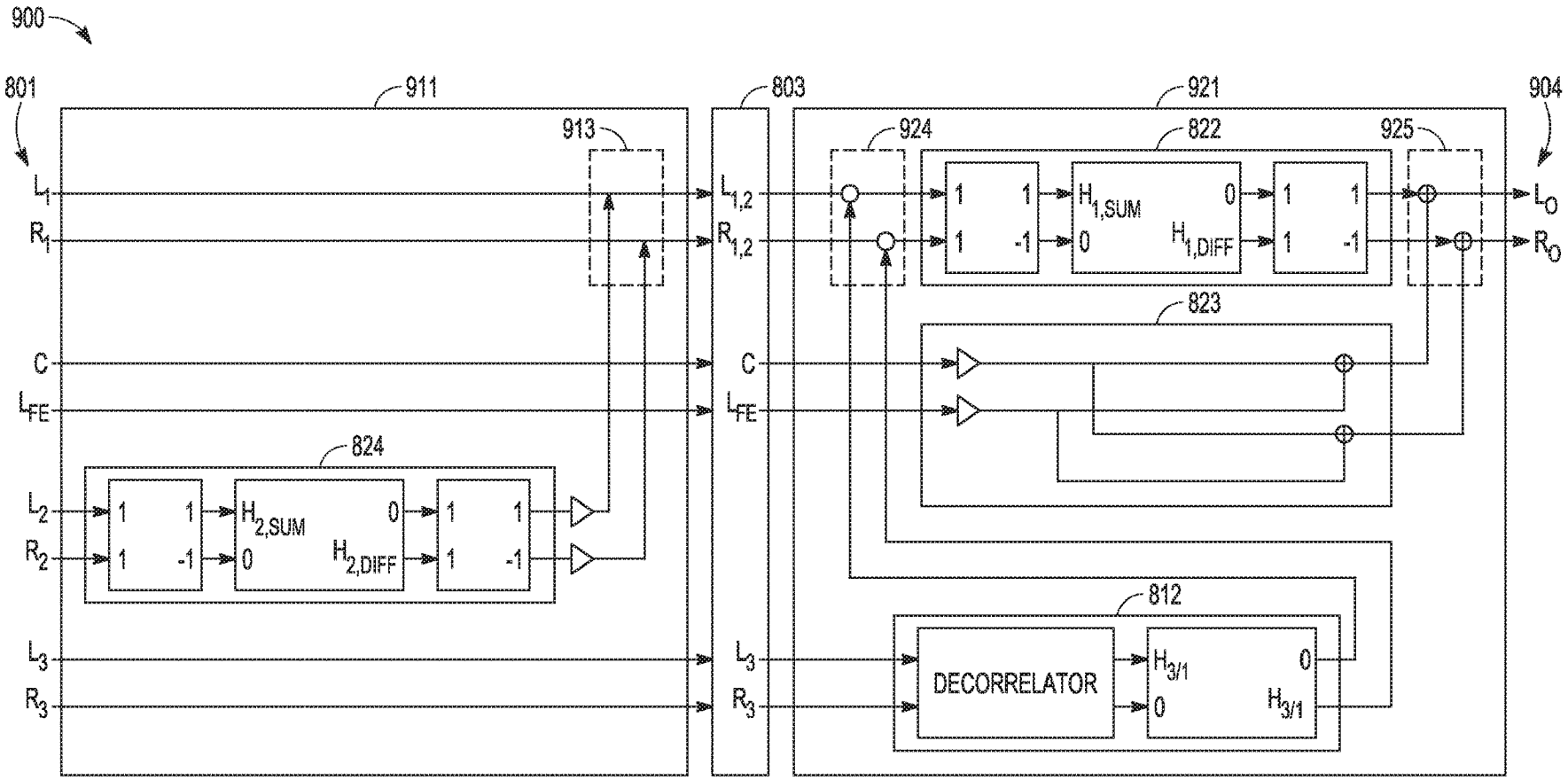
FIG. 9 illustrates generally an example of a second system configured to perform distributed virtualization processing on various audio signals.

FIG. 9 illustrates generally an example 900 of a second system configured to perform distributed virtualization processing on various audio signals. The example 900 includes a third audio processing module 911 coupled to a fourth audio processing module 921 using the third data bus circuit 803. The example of FIG. 9 includes or uses some of the same circuitry and processing as described above in the example 800 from FIG. 8.

For example, the third audio processing module 911 is configured to receive the various pairwise input signals 801, apply virtualization processing and reduce a total audio signal or channel count by combining one or more signals or channels following the virtualization processing. The third audio processing module 911 provides the reduced number of signals or channels to the fourth audio processing module 921 using the six-channel, third data bus circuit 803. The fourth audio processing module 921 applies other virtualization processing and renders, in the example of FIG. 9, a pairwise output signal 904. In an example, the pairwise output signals 804 and 904 from the examples of FIGS. 8 and 9 can be substantially the same when the various modules and processors are configured to provide substantially the same virtualization processing, however, in a different order and by operating on different base signals or combinations of signals.

In the example 900, the third audio processing module 911 includes first stage virtualization processing by the fourth processor circuit 824. That is, the fourth processor circuit 824 receives input signals $L_2$ and $R_2$, such as corresponding to rear stereo audio signals. Following the fourth processor circuit 824, output signals from the fourth processor circuit 824 can be combined with one or more others of the input signals 801. For example, as shown in FIG. 9, the output signals from the fourth processor circuit 824 can be combined or summed with the $L_1$ and $R_1$ signals, such as using a first summing circuit 913, to render signals $L_{1,2}$ and $R_{1,2}$. One or more others of the input signals 801 can be processed using the third audio processing module 911, however, discussion of such other processing is omitted for brevity and simplicity of the present illustrative example. With the partially-virtualized $L_2$ and $R_2$ signals combined with the input signals $L_1$ and $R_1$ to provide signals $L_{1,2}$ and $R_{1,2}$, the fourth audio processing module 911 can thus provide six output signals (e.g., designated $L_{1,2}$, $R_{1,2}$, $L_2$, $R_2$, C, and Lfe in the example of FIG. 9) to the third data bus circuit 803.

The third data bus circuit 803 can transmit the six signals to the fourth audio processing module 921. In the example, the fourth audio processing module 921 includes multiple second-stage virtualization processing circuits, including the first processor circuit 812, the second processor circuit 822, and the third processor circuit 823. In the illustration, the first, second, and third processor circuits 812, 822, and 823, are shown as discrete processors however processing operations for one or more the circuits can be combined or performed using one or more physical processing circuits in the fourth audio processing module 921. The second processor circuit 822 is configured to receive the signals $L_{1,2}$, and $R_{1,2}$, the first processor circuit 823 is configured to receive the signals $L_3$, and $R_3$, and the third processor circuit 824 is configured to receive the signals C, and Lfe. Virtualized outputs from the first processor circuit 812 are provided to a second summing circuit 924, where the outputs are summed with the received signals $L_{1,2}$, and $R_{1,2}$ from the third data bus circuit 803 and then provided to the second processor circuit 822. In this example, the second processor circuit 822 applies virtualization processing to a combination of the $L_2$, $R_2$, and the $L_3$ and $R_3$, signals after such signals have received other virtualization processing by the first and fourth processor circuits 812 and 824. Following processing in the fourth audio processing module 921, the outputs of the first, second, and third processor circuits 812, 822, and 823 are provided to a third summing circuit 925 that is configured to sum output signals from the various processor circuits to render the pairwise output signal 904, designated $L_O$ and $R_O$.

FIGS. 8 and 9 thus illustrate examples of pairwise, multi-channel virtualization processing system for two-channel output, such as over a frontal loudspeaker pair (see, e.g., FIG. 2). The examples include pairwise virtualization processing, such as illustrated in FIGS. 1 and 3-5. In the example of FIG. 8, the height channel pair ($L_3$, $R_3$) is processed using a first-stage virtualizer including a decorrelator. This virtualizer topology, including using a designated virtual height filter implemented by the first processor circuit 812, can be computationally advantageous because it enables sharing horizontal-plane virtualization processing with the front input signal pair. In addition, the illustrated topology allows an effectiveness or degree of the virtual height effect to be optimized or tuned, such as independently of the horizontal-plane or other virtualization processing. In the example of FIG. 9, the rear stereo channel pair ($L_2$, $R_2$) is processed using a first-stage virtualizer. This virtualizer topology, including using a designated virtual horizontal-plane filter implemented by the fourth processor circuit 824, can be computationally advantageous because it enables sharing height or other virtualization processing with the front input signal pair. Similarly to the example of FIG. 8, the illustrated topology of FIG. 9 optimizes tuning flexibility for virtualization processing in multiple different planes. For example, when the example of FIG. 9 is applied to render a two-channel output for headphone audio, this virtualizer topology provides independent tuning of virtual front and virtual rear effects over headphones for individual listeners, such as can be helpful to minimize occurrences of front-back confusion, spurious elevation errors, and to maximize perceived externalization.

Some modules or processors discussed herein are configured to apply or use signal decorrelation processing, such as prior to virtualization processing. Decorrelation is an audio processing technique that reduces a correlation between two or more audio signals or channels. In some examples, decorrelation can be used to modify a listener's perceived spatial imagery of an audio signal. Other examples of using decorrelation processing to adjust or modify spatial imagery or perception can include decreasing a perceived "phantom" source effect between a pair of audio channels, widening a perceived distance between a pair of audio channels, improving a perceived externalization of an audio signal when it is reproduced over headphones, and/or increasing a perceived diffuseness in a reproduced sound field. For example, by applying decorrelation processing to a left/right signal pair prior to virtualization, source signals panned between the left and right input channels will be heard by the listener at virtual positions substantially located on a shortest arc centered on the listener's position and joining the due positions of the virtual loudspeakers. The present inventors have realized that such decorrelation processing can be effective in avoiding various virtual localization artifacts, such as in-head localization, front-back confusion, and elevation errors.

In an example, decorrelation processing can be carried out using, among other things, an all-pass filter. The filter can be applied to at least one of the input signals and, in an example, can be realized by a nested all-pass filter. Inter-channel decorrelation can be provided by choosing different settings or values of different components of the filter. Various other designs for decorrelation filters can similarly be used.

In an example, a method for reducing correlation between two (or more) audio signals includes randomizing a phase of each audio signal. For example, respective all-pass filters, such as each based upon different random phase calculations in the frequency domain, can be used to filter each audio signal. In some examples, decorrelation can introduce timbral changes or other unintended artifacts into the audio signals, which can be separately addressed.

Various systems and machines can be configured to perform or carry out one or more of the signal processing tasks described herein. For example, any one or more of the virtualization processing modules or virtualization processor circuits, decorrelation circuits, virtualization or spatialization filters, or other modules or processes, can be implemented using a general-purpose machine or using a special, purpose-built machine that performs the various processing tasks, such as using instructions retrieved from a tangible, non-transitory, processor-readable medium.

Figure 10:
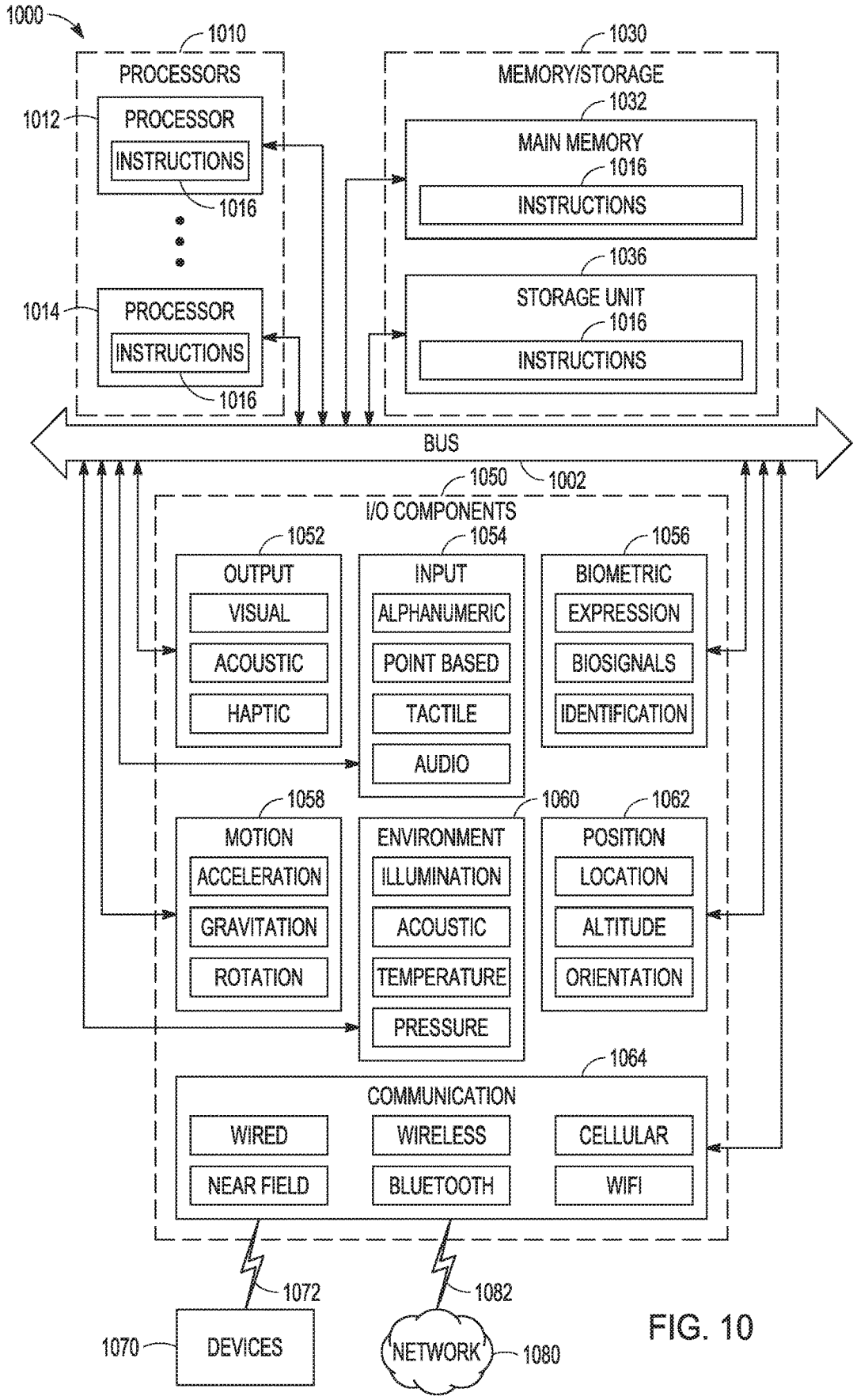
FIG. 10 is a block diagram illustrating components of a machine that is configurable to perform any one or more of the methodologies discussed herein.

FIG. 10 is a block diagram illustrating components of a machine 1000, according to some example embodiments, able to read instructions 1016 from a machine-readable medium (e.g., a machine-readable storage medium) and perform any one or more of the methodologies discussed herein. Specifically, FIG. 10 shows a diagrammatic representation of the machine 1000 in the example form of a computer system, within which the instructions 1016 (e.g., software, a program, an application, an applet, an app, or other executable code) for causing the machine 1000 to perform any one or more of the methodologies discussed herein may be executed. For example, the instructions 1016 can implement the various modules or circuits or components discussed herein. The instructions 1016 can transform the general, non-programmed machine 1000 into a particular machine programmed to carry out the described and illustrated functions in the manner described (e.g., as an audio processor circuit). In alternative embodiments, the machine 1000 operates as a standalone device or can be coupled (e.g., networked) to other machines. In a networked deployment, the machine 1000 can operate in the capacity of a server machine or a client machine in a server-client network environment, or as a peer machine in a peer-to-peer (or distributed) network environment.

The machine 1000 can comprise, but is not limited to, a server computer, a client computer, a personal computer (PC), a tablet computer, a laptop computer, a netbook, a set-top box (STB), a personal digital assistant (PDA), an entertainment media system or system component, a cellular telephone, a smart phone, a mobile device, a wearable device (e.g., a smart watch), a smart home device (e.g., a smart appliance), other smart devices, a web appliance, a network router, a network switch, a network bridge, a headphone driver, or any machine capable of executing the instructions 1016, sequentially or otherwise, that specify actions to be taken by the machine 1000. Further, while only a single machine 1000 is illustrated, the term "machine" shall also be taken to include a collection of machines 1000 that individually or jointly execute the instructions 1016 to perform any one or more of the methodologies discussed herein.

The machine 1000 can include or use processors 1010, such as including an audio processor circuit, non-transitory memory/storage 1030, and I/O components 1050, which can be configured to communicate with each other such as via a bus 1002. In an example embodiment, the processors 1010 (e.g., a central processing unit (CPU), a reduced instruction set computing (RISC) processor, a complex instruction set computing (CISC) processor, a graphics processing unit (GPU), a digital signal processor (DSP), an ASIC, a radio-frequency integrated circuit (RFIC), another processor, or any suitable combination thereof) can include, for example, a circuit such as a processor 1012 and a processor 1014 that may execute the instructions 1016. The term "processor" is intended to include a multi-core processor 1012, 1014 that can comprise two or more independent processors 1012, 1014 (sometimes referred to as "cores") that may execute the instructions 1016 contemporaneously. Although FIG. 10 shows multiple processors 1010, the machine 1000 may include a single processor 1012, 1014 with a single core, a single processor 1012, 1014 with multiple cores (e.g., a multi-core processor 1012, 1014), multiple processors 1012, 1014 with a single core, multiple processors 1012, 1014 with multiples cores, or any combination thereof, wherein any one or more of the processors can include a circuit configured to apply a height filter to an audio signal to render a processed or virtualized audio signal.

The memory/storage 1030 can include a memory 1032, such as a main memory circuit, or other memory storage circuit, and a storage unit 1036, both accessible to the processors 1010 such as via the bus 1002. The storage unit 1036 and memory 1032 store the instructions 1016 embodying any one or more of the methodologies or functions described herein. The instructions 1016 may also reside, completely or partially, within the memory 1032, within the storage unit 1036, within at least one of the processors 1010 (e.g., within the cache memory of processor 1012, 1014), or any suitable combination thereof, during execution thereof by the machine 1000. Accordingly, the memory 1032, the storage unit 1036, and the memory of the processors 1010 are examples of machine-readable media.

As used herein, "machine-readable medium" means a device able to store the instructions 1016 and data temporarily or permanently and may include, but not be limited to, random-access memory (RAM), read-only memory (ROM), buffer memory, flash memory, optical media, magnetic media, cache memory, other types of storage (e.g., erasable programmable read-only memory (EEPROM)), and/or any suitable combination thereof. The term "machine-readable medium" should be taken to include a single medium or multiple media (e.g., a centralized or distributed database, or associated caches and servers) able to store the instructions 1016. The term "machine-readable medium" shall also be taken to include any medium, or combination of multiple media, that is capable of storing instructions (e.g., instructions 1016) for execution by a machine (e.g., machine 1000), such that the instructions 1016, when executed by one or more processors of the machine 1000 (e.g., processors 1010), cause the machine 1000 to perform any one or more of the methodologies described herein. Accordingly, a "machine-readable medium" refers to a single storage apparatus or device, as well as "cloud-based" storage systems or storage networks that include multiple storage apparatus or devices. The term "machine-readable medium" excludes signals per se.

The I/O components 1050 may include a variety of components to receive input, provide output, produce output, transmit information, exchange information, capture measurements, and so on. The specific I/O components 1050 that are included in a particular machine 1000 will depend on the type of machine 1000. For example, portable machines such as mobile phones will likely include a touch input device or other such input mechanisms, while a headless server machine will likely not include such a touch input device. It will be appreciated that the I/O components 1050 may include many other components that are not shown in FIG. 10. The I/O components 1050 are grouped by functionality merely for simplifying the following discussion, and the grouping is in no way limiting. In various example embodiments, the I/O components 1050 may include output components 1052 and input components 1054. The output components 1052 can include visual components (e.g., a display such as a plasma display panel (PDP), a light emitting diode (LED) display, a liquid crystal display (LCD), a projector, or a cathode ray tube (CRT)), acoustic components (e.g., loudspeakers), haptic components (e.g., a vibratory motor, resistance mechanisms), other signal generators, and so forth. The input components 1054 can include alphanumeric input components (e.g., a keyboard, a touch screen configured to receive alphanumeric input, a photo-optical keyboard, or other alphanumeric input components), point based input components (e.g., a mouse, a touchpad, a trackball, a joystick, a motion sensor, or other pointing instruments), tactile input components (e.g., a physical button, a touch screen that provides location and/or force of touches or touch gestures, or other tactile input components), audio input components (e.g., a microphone), and the like.

In further example embodiments, the I/O components 1050 can include biometric components 1056, motion components 1058, environmental components 1060, or position components 1062, among a wide array of other components. For example, the biometric components 1056 can include components to detect expressions (e.g., hand expressions, facial expressions, vocal expressions, body gestures, or eye tracking), measure biosignals (e.g., blood pressure, heart rate, body temperature, perspiration, or brain waves), identify a person (e.g., voice identification, retinal identification, facial identification, fingerprint identification, or electroencephalogram based identification), and the like, such as can influence a inclusion, use, or selection of a listener-specific or environment-specific impulse response or HRTF, for example. In an example, the biometric components 1056 can include one or more sensors configured to sense or provide information about a detected location of the listener 110 in an environment. The motion components 1058 can include acceleration sensor components (e.g., accelerometer), gravitation sensor components, rotation sensor components (e.g., gyroscope), and so forth, such as can be used to track changes in the location of the listener 110. The environmental components 1060 can include, for example, illumination sensor components (e.g., photometer), temperature sensor components (e.g., one or more thermometers that detect ambient temperature), humidity sensor components, pressure sensor components (e.g., barometer), acoustic sensor components (e.g., one or more microphones that detect reverberation decay times, such as for one or more frequencies or frequency bands), proximity sensor or room volume sensing components (e.g., infrared sensors that detect nearby objects), gas sensors (e.g., gas detection sensors to detect concentrations of hazardous gases for safety or to measure pollutants in the atmosphere), or other components that may provide indications, measurements, or signals corresponding to a surrounding physical environment. The position components 1062 can include location sensor components (e.g., a Global Position System (GPS) receiver component), altitude sensor components (e.g., altimeters or barometers that detect air pressure from which altitude may be derived), orientation sensor components (e.g., magnetometers), and the like.

Communication can be implemented using a wide variety of technologies. The I/O components 1050 can include communication components 1064 operable to couple the machine 1000 to a network 1080 or devices 1070 via a coupling 1082 and a coupling 1072 respectively. For example, the communication components 1064 can include a network interface component or other suitable device to interface with the network 1080. In further examples, the communication components 1064 can include wired communication components, wireless communication components, cellular communication components, near field communication (NFC) components, Bluetooth® components (e.g., Bluetooth® Low Energy), Wi-Fi® components, and other communication components to provide communication via other modalities. The devices 1070 can be another machine or any of a wide variety of peripheral devices (e.g., a peripheral device coupled via a USB).

Moreover, the communication components 1064 can detect identifiers or include components operable to detect identifiers. For example, the communication components 1064 can include radio frequency identification (RFID) tag reader components, NFC smart tag detection components, optical reader components (e.g., an optical sensor to detect one-dimensional bar codes such as Universal Product Code (UPC) bar code, multi-dimensional bar codes such as Quick Response (QR) code, Aztec code, Data Matrix, Dataglyph, MaxiCode, PDF49, Ultra Code, UCC RSS-2D bar code, and other optical codes), or acoustic detection components (e.g., microphones to identify tagged audio signals). In addition, a variety of information can be derived via the communication components 1064, such as location via Internet Protocol (IP) geolocation, location via Wi-Fi® signal triangulation, location via detecting an NFC beacon signal that may indicate a particular location, and so forth. Such identifiers can be used to determine information about one or more of a reference or local impulse response, reference or local environment characteristic, or a listener-specific characteristic.

In various example embodiments, one or more portions of the network 1080 can be an ad hoc network, an intranet, an extranet, a virtual private network (VPN), a local area network (LAN), a wireless LAN (WLAN), a wide area network (WAN), a wireless WAN (WWAN), a metropolitan area network (MAN), the Internet, a portion of the Internet, a portion of the public switched telephone network (PSTN), a plain old telephone service (POTS) network, a cellular telephone network, a wireless network, a Wi-Fi® network, another type of network, or a combination of two or more such networks. For example, the network 1080 or a portion of the network 1080 can include a wireless or cellular network and the coupling 1082 may be a Code Division Multiple Access (CDMA) connection, a Global System for Mobile communications (GSM) connection, or another type of cellular or wireless coupling. In this example, the coupling 1082 can implement any of a variety of types of data transfer technology, such as Single Carrier Radio Transmission Technology (1×RTT), Evolution-Data Optimized (EVDO) technology, General Packet Radio Service (GPRS) technology, Enhanced Data rates for GSM Evolution (EDGE) technology, third Generation Partnership Project (3GPP) including 3G, fourth generation wireless (4G) networks, Universal Mobile Telecommunications System (UMTS), High Speed Packet Access (HSPA), Worldwide Interoperability for Microwave Access (WiMAX), Long Term Evolution (LTE) standard, others defined by various standard-setting organizations, other long range protocols, or other data transfer technology. In an example, such a wireless communication protocol or network can be configured to transmit headphone audio signals from a centralized processor or machine to a headphone device in use by a listener.

The instructions 1016 can be transmitted or received over the network 1080 using a transmission medium via a network interface device (e.g., a network interface component included in the communication components 1064) and using any one of a number of well-known transfer protocols (e.g., hypertext transfer protocol (HTTP)). Similarly, the instructions 1016 can be transmitted or received using a transmission medium via the coupling 1072 (e.g., a peer-to-peer coupling) to the devices 1070. The term "transmission medium" shall be taken to include any intangible medium that is capable of storing, encoding, or carrying the instructions 1016 for execution by the machine 1000, and includes digital or analog communications signals or other intangible media to facilitate communication of such software.

Many variations of the concepts and examples discussed herein will be apparent to those skilled in the relevant arts. For example, depending on the embodiment, certain acts, events, or functions of any of the methods, processes, or algorithms described herein can be performed in a different sequence, can be added, merged, or omitted (such that not all described acts or events are necessary for the practice of the various methods, processes, or algorithms). Moreover, in some embodiments, acts or events can be performed concurrently, such as through multi-threaded processing, interrupt processing, or multiple processors or processor cores or on other parallel architectures, rather than sequentially. In addition, different tasks or processes can be performed by different machines and computing systems that can function together.

The various illustrative logical blocks, modules, methods, and algorithm processes and sequences described in connection with the embodiments disclosed herein can be implemented as electronic hardware, computer software, or combinations of both. To illustrate this interchangeability of hardware and software, various components, blocks, modules, and process actions are, in some instances, described generally in terms of their functionality. Whether such functionality is implemented as hardware or software depends upon the particular application and design constraints imposed on the overall system. The described functionality can thus be implemented in varying ways for a particular application, but such implementation decisions should not be interpreted as causing a departure from the scope of this document. Embodiments of the immersive spatial audio processing and reproduction systems and methods and techniques described herein are operational within numerous types of general purpose or special purpose computing system environments or configurations, such as described above in the discussion of FIG. 10.

Various aspects of the invention can be used independently or together. For example, Aspect 1 can include or use subject matter (such as an apparatus, a system, a device, a method, a means for performing acts, or a device readable medium including instructions that, when performed by the device, can cause the device to perform acts), such as can include or use a method for providing virtualized audio information, the method comprising receiving audio program information comprising at least N discrete audio signals and generating, using a first virtualization processor circuit, intermediate virtualized audio information using at least a portion of the received audio program information. In Aspect 1, the generating can include, among other things applying a first virtualization filter to M of the N audio signals to provide a first virtualization filter output, and providing the intermediate virtualized audio information using the first virtualization filter output, wherein the intermediate virtualized audio information comprises J discrete audio signals. Aspect 1 can further include transmitting the intermediate virtualized audio information to a second virtualization processor circuit, wherein the second virtualization processor circuit is configured to generate further virtualized audio information by applying a different second virtualization filter to one or more of the J audio signals. In an example, N, M, and J are integers.

Aspect 2 can include or use, or can optionally be combined with the subject matter of Aspect 1, to optionally include rendering K output signals based on the further virtualized audio information, wherein the K output signals are configured for reproduction using headphones.

Aspect 3 can include or use, or can optionally be combined with the subject matter of Aspect 1, to optionally include rendering K output signals based on the further virtualized audio information, wherein the K output signals are configured for reproduction using a pair of loudspeakers.

Aspect 4 can include or use, or can optionally be combined with the subject matter of one or any combination of Aspects 1 through 3 to optionally include the audio program information comprises at least one height audio signal that includes audio information configured for reproduction using at least one elevated loudspeaker, and wherein the applying the first virtualization filter includes applying a height virtualization filter to the at least one height audio signal.

Aspect 5 can include or use, or can optionally be combined with the subject matter of Aspect 4, to optionally include generating the further virtualized audio information using the second virtualization processor circuit, including applying a virtualization filter other than a height virtualization filter to one or more of the J audio signals.

Aspect 6 can include or use, or can optionally be combined with the subject matter of one or any combination of Aspects 1 through 5 to optionally include the audio program information comprises surround sound audio signals that include audio information for reproduction using multiple respective loudspeakers, and wherein the applying the first virtualization filter includes applying a horizontal-plane virtualization filter to one or more of the surround sound signals, and wherein the applying the different second virtualization filter to the one or more of the J audio signals includes applying other than a horizontal-plane virtualization filter.

Aspect 7 can include or use, or can optionally be combined with the subject matter of one or any combination of Aspects 1 through 5 to optionally include the audio program information comprises at least left and right front audio signals that include audio information configured for reproduction using respective front left and front right loudspeakers, and wherein the applying the first virtualization filter includes applying a horizontal-plane virtualization filter to at least the left and right front audio signals.

Aspect 8 can include or use, or can optionally be combined with the subject matter of one or any combination of Aspects 1 through 7, to optionally include A is less than N.

Aspect 9 can include or use, or can optionally be combined with the subject matter of Aspect 8, to optionally include the providing the intermediate virtualized audio information using the first virtualization filter output includes combining the first virtualization filter output with one or more of the N audio signals that are other than the M audio signals.

Aspect 10 can include or use, or can optionally be combined with the subject matter of one or any combination of Aspects 1 through 9 to optionally include M is equal to N.

Aspect 11 can include or use, or can optionally be combined with the subject matter of one or any combination of Aspects 1 through 10 to optionally include J is less than N.

Aspect 12 can include or use, or can optionally be combined with the subject matter of one or any combination of Aspects 1 through 11 to optionally include receiving, at the second virtualization processor circuit, the intermediate virtualized audio information, and generating, using the second virtualization processor circuit, the further virtualized audio information by applying the different second virtualization filter to the one or more of the J audio signals.

Aspect 13 can include or use, or can optionally be combined with the subject matter of Aspect 12, to optionally include the generating the further virtualized audio information includes rendering K output signals for playback using at least K loudspeakers, wherein K is an integer less than J.

Aspect 14 can include or use, or can optionally be combined with the subject matter of Aspect 13, to optionally include the rendering K output signals includes rendering a pair of output signals configured for reproduction using headphones or loudspeakers.

Aspect 15 can include or use, or can optionally be combined with the subject matter of Aspect 13, to optionally include the at least K loudspeakers are arranged in a first spatial plane, and wherein the generating the further virtualized audio information includes rendering output signals that, when reproduced using the K loudspeakers, are configured to be perceived by a listener as including audible information in other than the first spatial plane.

Aspect 16 can include or use, or can optionally be combined with the subject matter of Aspect 13, to optionally include the generating the further virtualized audio information includes generating the information such that when the further virtualized audio information is reproduced using the at least K loudspeakers, the further virtualized audio information is perceived by a listener as originating from an elevated or lowered source relative to a plane of the loudspeakers.

Aspect 17 can include or use, or can optionally be combined with the subject matter of one or any combination of Aspects 1 through 16 to optionally include the transmitting the intermediate virtualized audio information includes using a data bus comprising fewer than N channels.

Aspect 18 can include or use, or can optionally be combined with the subject matter of one or any combination of Aspects 1 through 17 to optionally include the generating the intermediate virtualized audio information includes decorrelating at least two of the M audio signals before applying the first virtualization filter.

Aspect 19 can include, or can optionally be combined with the subject matter of one or any combination of Aspects 1 through 18 to include or use, subject matter (such as an apparatus, a method, a means for performing acts, or a machine readable medium including instructions that, when performed by the machine, that can cause the machine to perform acts), such as can include or use a system comprising means for receiving multiple audio input signals, means for applying first virtualization processing to one or more of the multiple audio input signals to generate an intermediate virtualized signal, means for combining the intermediate virtualized signal with at least one other of the multiple audio input signals to provide a partially virtualized signal, and means for applying second virtualization processing to the partially virtualized audio signal to generate a virtualized audio output signal.

Aspect 20 can include or use, or can optionally be combined with the subject matter of Aspect 19 to optionally include means for transmitting the partially virtualized signal from a first device to a remote second device that comprises the means for applying the second virtualization processing, wherein the multiple audio input signals comprise at least N discrete signals, and wherein the means for transmitting the partially virtualized signal comprises means for transmitting fewer than N signals.

Aspect 21 can include or use, or can optionally be combined with the subject matter of one or any combination of Aspects 19 or 20 to optionally include the means for applying the first virtualization processing comprises means for applying one of horizontal-plane virtualization and vertical-plane virtualization, and wherein the means for applying the second virtualization processing comprises means for applying the other one of horizontal-plane virtualization and vertical-plane virtualization.

Aspect 22 can include or use, or can optionally be combined with the subject matter of one or any combination of Aspects 19 through 21 to optionally include the means for applying the first virtualization processing comprises means for applying a first head-related transfer function to at least one of the multiple audio input signals.

Aspect 23 can include or use, or can optionally be combined with the subject matter of one or any combination of Aspects 19 through 22 to optionally include means for decorrelating at least two of the multiple audio input signals to provide multiple decorrelated signals, and wherein the means for applying the first virtualization processing includes means for applying the first virtualization processing to a first one of the decorrelated signals.

Aspect 24 can include or use, or can optionally be combined with the subject matter of one or any combination of Aspects 19 through 23 to optionally include the means for applying the second virtualization processing further includes means for generating a stereo pair of virtualized audio output signals representative of the multiple audio input signals.

Aspect 25 can include or use, or can optionally be combined with the subject matter of one or any combination of Aspects 19 through 24 to optionally include the means for receiving multiple audio input signals includes means for receiving N discrete audio input signals, wherein the means for combining the intermediate virtualized signal with at least one other of the multiple audio input signals includes means to provide multiple partially virtualized signals, and wherein the number of partially virtualized signals is fewer than N.

Aspect 26 can include, or can optionally be combined with the subject matter of one or any combination of Aspects 1 through 25 to include or use, subject matter (such as an apparatus, a method, a means for performing acts, or a machine readable medium including instructions that, when performed by the machine, that can cause the machine to perform acts), such as can include or use an audio signal processing system configured to provide virtualized audio information in a three-dimensional soundfield using at least a pair of loudspeakers or headphones, wherein the virtualized audio information is perceived by a listener as including audible information in other than a first anatomical plane of the listener, the system comprising an audio input configured to receive audio program information that includes at least N discrete audio signals, a first virtualization processor circuit configured to generate intermediate virtualized audio information by applying a first virtualization filter to M of the N audio signals, and a second virtualization processor circuit configured to generate further virtualized audio information by applying a different second virtualization filter to K of the N audio signals, wherein K, M, and N are integers.

Aspect 27 can include or use, or can optionally be combined with the subject matter of Aspect 26, to optionally include an audio signal combination circuit configured to combine the intermediate virtualized audio information with at least one of the N audio signals, other than the M audio signals, to provide partially virtualized audio program information that includes fewer than N audio signals, wherein the second virtualization processor circuit is configured to generate the further virtualized audio information using the partially virtualized audio program information.

Aspect 28 can include or use, or can optionally be combined with the subject matter of one or any combination of Aspects 26 or 27 to optionally include a data bus circuit comprising fewer than N channels, wherein the data bus circuit is coupled to the first and second virtualization processor circuits and the data bus circuit is configured to transmit the partially virtualized audio program information from the first virtualization processor circuit to the second virtualization processor circuit.

Aspect 29 can include or use, or can optionally be combined with the subject matter of one or any combination of Aspects 26 through 28 to optionally include an audio decoder circuit configured to receive surround sound source signals and provide the audio program information to the audio input based on the received surround sound source signals.

Aspect 30 can include or use, or can optionally be combined with the subject matter of one or any combination of Aspects 26 through 29 to optionally include the received audio program information comprises at least one height audio signal that includes audio information configured for reproduction using at least one elevated loudspeaker, wherein the first virtualization processor circuit is configured to apply the first virtualization filter as a height virtualization filter to the at least one height audio signal.

Aspect 31 can include or use, or can optionally be combined with the subject matter of Aspect 30, to optionally include the second virtualization filter is other than a height virtualization filter.

Aspect 32 can include or use, or can optionally be combined with the subject matter of one or any combination of Aspects 26 through 31 to optionally include a decorrelation circuit configured to apply a decorrelation filter to one or more of the N discrete audio signals to provide corresponding one or more decorrelated signals to the first and/or second virtualization processor circuit.

Aspect 33 can include or use, or can optionally be combined with the subject matter of one or any combination of Aspects 26 through 32 to optionally include the first and/or second virtualization processor circuit includes a head-related transfer function derivation circuit configured to derive the first virtualization filter based on ipsilateral and contralateral head-related transfer function information corresponding to a listener.

Aspect 34 can include or use, or can optionally be combined with the subject matter of one or any combination of Aspects 26 through 33 to optionally include the second virtualization processor circuit is configured to generate the further virtualized audio information as a stereo pair of signals configured for reproduction using headphones or loudspeakers.

Each of these non-limiting Aspects can stand on its own, or can be combined in various permutations or combinations with one or more of the other Aspects or examples provided herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein."

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments of the inventions described herein can be embodied within a form that does not provide all of the features and benefits set forth herein, as some features can be used or practiced separately from others.

Moreover, although the subject matter has been described in language specific to structural features or methods or acts, it is to be understood that the subject matter defined in the appended claims is not necessarily limited to the specific features or acts described above. Rather, the specific features and acts described above are disclosed as example forms of implementing the claims.

What is claimed is:

1. A method for providing virtualized audio information, the method comprising:

receiving surround sound audio program information comprising at least N discrete audio signals wherein the N discrete audio signals are configured for reproduction using respective ones of N different loudspeakers in different surround sound loudspeaker locations relative to a listener;

generating, using a first virtualization processor circuit, intermediate virtualized audio information using a portion of the received surround sound audio program information, the generating including:

applying a first virtualization filter to M of the N audio signals to provide a first virtualization filter output, wherein the first virtualization filter is based in part on a first transfer function characteristic; and providing the intermediate virtualized audio information using the first virtualization filter output, wherein the intermediate virtualized audio information comprises J discrete audio signals; and transmitting the intermediate virtualized audio information to a second virtualization processor circuit, wherein the second virtualization processor circuit is configured to generate further virtualized audio information by applying a second virtualization filter to one or more of the J audio signals, wherein the second virtualization filter is based in part on the same first transfer function characteristic, and wherein the first and second virtualization filters are different filters;

wherein N, M, and J are integers; and wherein the first transfer function characteristic includes a combination of ipsilateral and contralateral head-related transfer functions for a virtual source.

2. The method of claim 1, further comprising rendering K output signals based on the further virtualized audio information, wherein the K output signals are configured for reproduction using headphones.

3. The method of claim 1, further comprising rendering K output signals based on the further virtualized audio information, wherein the K output signals are configured for reproduction using a pair of loudspeakers.

4. The method of claim 1, wherein the surround sound audio program information comprises at least one height audio signal that includes audio information configured for reproduction using at least one elevated loudspeaker, and wherein the applying the first virtualization filter includes applying a height virtualization filter to the at least one height audio signal.

5. The method of claim 4, further comprising generating the further virtualized audio information using the second virtualization processor circuit, including applying a virtualization filter other than a height virtualization filter to one or more of the J audio signals.

6. The method of claim 1, wherein the applying the first virtualization filter includes applying a horizontal-plane virtualization filter to one or more of the audio signals from the surround sound audio program; and wherein the applying the second virtualization filter to the one or more of the J audio signals includes applying other than a horizontal-plane virtualization filter.

7. The method of claim 1, wherein the surround sound audio program information comprises at least left and right front audio signals that include audio information configured for reproduction using respective front left and front right loudspeakers, and wherein the applying the first virtualization filter includes applying a horizontal-plane virtualization filter to at least the left and right front audio signals.

8. The method of claim 1, wherein M is less than or equal to N.

9. The method of claim 8, wherein the providing the intermediate virtualized audio information using the first virtualization filter output includes combining the first virtualization filter output with one or more of the N audio signals that are other than the M audio signals.

10. The method of claim 1, wherein J is less than N.

11. The method of claim 1, further comprising:

receiving, at the second virtualization processor circuit, the intermediate virtualized audio information; and generating, using the second virtualization processor circuit, the further virtualized audio information by applying the second virtualization filter to the one or more of the J audio signals;

wherein the generating the further virtualized audio information includes rendering K output signals for playback using at least K loudspeakers, wherein K is an integer less than J.

12. The method of claim 1, wherein the virtual source includes a virtual loudspeaker.

13. A system comprising:

means for receiving a multiple-channel audio input that includes audio signals in an immersive audio program format, wherein the audio signals in the immersive audio program format are intended for reproduction using respective different loudspeakers in different locations relative to a listener;

means for applying first virtualization processing to one or more of the audio signals in the immersive audio program format to generate an intermediate virtualized signal;

means for combining the intermediate virtualized signal with at least one other of the audio signals in the immersive audio program format to provide a partially virtualized signal; and means for applying second virtualization processing to the partially virtualized audio signal to generate a virtualized audio output signal, wherein the first and second virtualization processing include or use at least a portion of the same transfer function filter information for a virtual source, the transfer function filter information including information about a combination of ipsilateral and contralateral head-related transfer functions.

14. The system of claim 13, further comprising means for transmitting the partially virtualized signal from a first device to a remote second device that comprises the means for applying the second virtualization processing;

wherein the audio signals in the immersive audio program format comprise at least N discrete signals; and wherein the means for transmitting the partially virtualized signal comprises means for transmitting fewer than N signals.

15. The system of claim 13, wherein the means for applying the first virtualization processing comprises means for applying one of horizontal-plane virtualization and vertical-plane virtualization, and wherein the means for applying the second virtualization processing comprises means for applying the other one of horizontal-plane virtualization and vertical-plane virtualization.

16. The system of claim 13, further comprising means for decorrelating at least two of the audio signals to provide multiple decorrelated signals, and wherein the means for applying the first virtualization processing includes means for applying the first virtualization processing to a first one of the decorrelated signals.

17. The system of claim 13, wherein the means for receiving the input that includes audio signals in an immersive audio program format includes means for receiving N discrete audio input signals;

wherein the means for combining the intermediate virtualized signal with at least one other of the audio signals in the immersive audio program format includes means to provide multiple partially virtualized signals; and wherein the number of partially virtualized signals is fewer than N.

18. The system of claim 13, wherein the means for receiving the multiple-channel audio input that includes audio signals in an immersive audio program format includes means for receiving audio signals in a surround sound format.

19. An audio signal processing system configured to provide virtualized audio information in a three-dimensional soundfield using at least a pair of loudspeakers or headphones, wherein the virtualized audio information is perceived by a listener as including audible information in other than a first anatomical plane of the listener, the system comprising:

an audio input configured to receive surround sound audio program information that includes at least N discrete audio signals wherein the N discrete audio signals are configured for reproduction using respective ones of N different loudspeakers in different surround sound loudspeaker locations relative to the listener;

a first virtualization processor circuit configured to generate intermediate virtualized audio information by applying a first virtualization filter to M of the N audio signals, wherein the first virtualization filter is based in part on a first transfer function characteristic;

a second virtualization processor circuit configured to generate further virtualized audio information by applying a second virtualization filter to K of the N audio signals, wherein the second virtualization filter is based in part on the same first transfer function characteristic, and wherein the second virtualization filter is different than the first virtualization filter; and a decorrelation circuit configured to apply a decorrelation filter to one or more of the N discrete audio signals to provide corresponding one or more decorrelated signals to the first and/or second virtualization processor circuit;

wherein K, M, and N are integers; and wherein the first transfer function characteristic includes a combination of ipsilateral and contralateral head-related transfer functions for a virtual source.

20. The system of claim 19, further comprising an audio signal combination circuit configured to combine the intermediate virtualized audio information with at least one of the N audio signals, other than the M audio signals, to provide partially virtualized surround sound audio program information that includes fewer than N audio signals;

wherein the second virtualization processor circuit is configured to generate the further virtualized audio information using the partially virtualized surround sound audio program information.

* * * * *